US005931018A

United States Patent [19]

Hall et al.

[11] Patent Number: 5,931,018

[45] **Date of Patent: *Aug. 3, 1999**

[54] METHOD AND APPARATUS TO COOL FOOD CONTACT MACHINES AND SURFACES

[76] Inventors: Renee M. Hall; Donald M. Hall, both of 63 North Country Rd., Mt. Sinai, N.Y. 11766

[ * ] Notice: This patent is subject to a terminal disclaimer.

[21] Appl. No.: 09/056,158

[22] Filed: Apr. 6, 1998

Related U.S. Application Data

[63] Continuation-in-part of application No. 08/778,958, Jan. 6, 1997, Pat. No. 5,746,063

[60] Provisional application No. 60/042,954, Apr. 7, 1997.

[51] Int. Cl.[6] ..... F25D 15/00; F25D 17/02

[52] U.S. Cl. ..... 62/331; 62/249; 62/98; 62/DIG. 10

[58] Field of Search ..... 62/3.2, 3.6, 3.62, 62/249, 331, 404, 79, 89, 96, 98, 99, 238.1, 238.6, 246, 336, DIG. 10

[56] References Cited

U.S. PATENT DOCUMENTS

| | | | |
|---|---|---|---|
| 1,471,083 | 10/1923 | Wingard et al. | 62/249 |
| 2,105,566 | 1/1938 | Waunch | 62/331 |
| 2,156,795 | 5/1939 | Smith | 62/331 |
| 2,665,724 | 1/1954 | Lundell | 62/331 |
| 2,931,408 | 4/1960 | Dwyer et al. | 62/331 |
| 5,746,063 | 5/1998 | Hall et al. | 62/331 |
| 5,765,386 | 6/1998 | Hall et al. | 62/331 |
| 5,816,051 | 10/1998 | Hall et al. | 62/3.62 |

FOREIGN PATENT DOCUMENTS

| | | | |
|---|---|---|---|
| 1959756 | 6/1978 | Germany | 62/249 |

*Primary Examiner*—William Doerrler
*Attorney, Agent, or Firm*—Alfred M. Walker

[57] ABSTRACT

A cooling and refrigeration apparatus cools one or more surfaces of one or more food handling devices, such as meat cutting machines, scales, and food preparation areas, so as to inhibit bacterial and other microbial growth thereon. The apparatus includes one or more coolers to lower the temperature of the food contact surfaces to a predetermined temperature which inhibits bacteria and other microbial growth thereon, by providing one or more surfaces at the predetermined temperature adjacent to or at the one or more food handling surfaces. The cooler includes a distributor system of conduit passageways and other distribution devices to distribute one or more cooling media to conductive surfaces of the one or more food handling devices.

48 Claims, 19 Drawing Sheets

METHOD AND APPARATUS TO COOL FOOD CONTACT MACHINES AND SURFACES

This application is based upon provisional application number 60/042,954, filed Apr. 7, 1997. This application is also a continuation-in-part of application Ser. No. 08/778,958, filed Jan. 6, 1997, now U.S. Pat. No. 5,756,063.

FIELD OF THE INVENTION

The present invention is related to cooling and refrigeration methods and devices to cool surfaces of meat cutting machines, food weighing scales, and food preparation work surfaces so as to inhibit or significantly reduce bacterial growth.

BACKGROUND OF THE INVENTION

The danger of bacterial infestation of food products such as meat is well known. It is also known that bacteria congregate and grow on meat handling surfaces such as meat slicers, food weighing scales and food preparation work surfaces. This also applies to other foods such as fish and cheese. It is further known that refrigeration of food inhibits the growth of bacteria.

OBJECTS OF THE INVENTION

It is therefore an object of the present invention to reduce the temperature of food contact surfaces below ambient temperature to inhibit bacterial growth and preferably to a temperature equal to or below the bacteriostat temperature of health and sanitary code standards for food preservation and preparation.

It is also an object of the present invention to be able to retrofit existing meat slicers and scales with this cooling apparatus.

It is another object of the present invention to optimally cool the surfaces of newly configured meat slicers and scales.

It is yet another object of the present invention to cool food preparation surfaces on tables, counter tops, cabinets, work counters, special purpose food preparation stations and on portable food preparation work surfaces.

It is a further object of the present invention to use thermoelectric devices to produce the cooling effect.

It is another object of the present invention to use cool air streams to reduce or eliminate condensation of ambient humidity on these cooled surfaces.

It is a further object of the present invention to rely on existing refrigerated equipment to supply the cooling energy required for these surface cooling efforts.

It is yet another object of the present invention to provide a distribution system of conduit passageways within the frame of a food handling device to maximize the distribution of chilled temperature throughout.

It is yet another object of the present invention to maximize the distribution of chilled air throughout the air space within the vicinity of a food preparation surface of a food preparation device.

It is yet another object to provide couplings for easy attachment of chilled fluid and chilled air passageways within food preparation devices.

It is yet another object of the present invention to passively reduce humidity and odors in the vicinity of food preparation devices.

It is yet another object of the present invention to provide multiple ports in a refrigerated food display case to transfer one or more cooling media therefrom to one or more food slicers, weighing scales or food preparation surfaces.

It is yet another object of the present invention to provide ports for the engagement of food slicers, scales, food preparation devices and the like into the interior cavity of a refrigerated delicatessen case, such that the portion of the device that is inserted therein will be able to absorb the chilled temperature of the refrigerated case and transfer same through the use of the cooling medium to the device to be chilled, which may be made more efficient by use of optional fins as shown.

SUMMARY OF THE INVENTION

In keeping with these objects and others which may become apparent, the present invention relates to methods and refrigeration and cooling devices combined with machines such as meat slicers and scales to lower their surface temperatures to inhibit bacterial growth. The present invention also applies to the cooling of food preparation surfaces, such as tables, cabinets, work counters, special purpose food preparation stations, and on portable food preparation work surfaces.

This reduction in temperature is predetermined to be sufficient to reduce the overall temperature of the slicer body frame equal to, or below, the temperature that is specified for refrigerated food storage. The reduction in temperature may also be optionally predetermined to be any other temperature below the ambient temperature, that may not be as low as the temperature prescribed as suitable for perishable food storage, but wherein the reduced temperature in the areas where food comes in contact with the slicer is sufficiently low enough to reduce the amount of bacteria that grows on one or more slicer bodies and/or slicer blades or areas of one or more food weighing scales that come in contact with food, or the work surface areas of one or more food preparation tables, such as described hereinbelow.

Bacteria grows on the slicer body or slicer blade due to the meat juices and food debris deposited on the slicer following the act of cutting or slicing meats and/or cheeses. Bacteria also grows on the weighing scale after weighing of food, if the food contacts the scale, and likewise on the work surface when food is being prepared, such as in the act of making sandwiches with sliced meats or cheeses. A number of methods can be employed to accomplish the reduction in temperature of the slicer frame, slicer blade, weighing scale or other food preparation surface.

For example, a food slicer, weighing scale or other food preparation surface, may be equipped with thermoelectric cooling, wherein the frames of the food slicer, weighing scale or food preparation surface are usually made of a material, such as cast aluminum, which has good thermal conductivity and lends itself to retrofitting with thermoelectric modules that can be adhesively or mechanically bonded by their cold plates to the various surfaces of the food slicer, weighing scale or food preparation surface. Food preparation work surfaces have food contact surfaces that are frequently fabricated from stainless steel which, while not as conductive as aluminum, can be successfully chilled. The base of the slicer, weighing scale or food preparation surface, may preferably include a thermoelectric module thereon on a surface, such as the underside thereof. With respect to a food slicer, the carriage of the slicer is moved by an insulated handle for operator comfort. The cutting blade of the food slicer, and its cutting carriage, and the respective surfaces of the weighing scale or food preparation surface, are cooled by one or more thermoelectric modules, which may optionally include a plurality thereof, such as three thermoelectric modules located on the blade cover of the slicer.

Each cooler, such as a thermoelectric module, reduces the surface temperature, of a food handling surface adjacent to or on top of, the thermoelectric module, to a predetermined temperature below which temperature the growth of bacteria and other microorganisms is inhibited or significantly reduced.

Optionally, when a sponge is used to periodically clean the slicer blade by actually slicing it with the meat slicer, another optional accessory to reduce bacterial growth on the sponge is storage of the sponge in a cooled compartment with its own thermoelectric module, or other source or supply of cooling. The cooling compartment may also be used to store other commonly used food preparation utensils, such as a trim knife.

An angled trough preferably encircles the base of the slicing machine and collects humid condensate to be discarded.

The humid condensate is also removed by a conduit, such as a hose, that drips directly into a collection drain.

The thermoelectric module preferably includes one or more layers, such as three layers. Optionally, it can also have a pancake fan as a fourth layer. A cooling plate of the thermoelectric module is cooled by supplying electrical power, such as, for example, direct current, to a thermoelectric layer which draws heat from the cooling plate to a hot finned plate.

In connection with the thermoelectric module, an enlarged heat sink or finned heat exchanger may be used to dissipate the heat passively to ambient air by natural convection. An optional small flat fan unit can draw ambient air and discharges heated air peripherally through fins. The optional fan insulates personnel using the device from a hot plate and enhances the efficiency of the thermoelectric module. In one embodiment, one or more thermoelectric modules used on the slicing machine, weighing scale or food preparation surface are wired in parallel to an electrical power supply, such as, for example, a direct current low voltage power supply, which may be remotely located or placed under or adjacent to the meat slicer, weighing scale or food preparation surface. Furthermore, a built-in power supply compartment and switch may be optionally provided.

The thermoelectric module may also act as a bacteriostat or microbial reducer for different types of meat slicers, such as to cool a spiked meat cutting plate with upwardly extending meat spikes. In this embodiment, a cold plate of the thermoelectric module is attached by bonding or otherwise to a base plate, to cool the spikes by conduction. The upwardly extending meat spikes must be cooled, since the spikes contact a food item, such as a piece of meat.

In the embodiment for a typical meat weighing scale, having a base and a food platform, the scale uses a thermoelectric module to cool the food contact surface by conduction. While this embodiment can be used to retrofit some scales, a predetermined distance must be provided between the thermoelectric module and the base.

When applied to a conventional scale, the cooling accessory may be a separate cooling unit providing cool air streams to the scale. The separate cooling accessory may use either thermoelectric modules such as, for example, solid state thermoelectric modules, or a conventional vapor compression refrigeration system to provide a supply of cool air, or it may draw cool air from the interior of a nearby refrigerated case.

In one particular embodiment, ambient air is drawn through one or more intake vents and is cooled within the unit. The cool air streams are then discharged respectively through outlets, such as one or more adjustable outlet nozzles, so that they impinge on the top surface and underside of the food weighing platform of the scale. Additional ambient air may be drawn through vents to cool the condenser of a conventional refrigeration apparatus or the hot plates of thermoelectric modules. The heated air may be then discharged through outlets, such as outlet vents on top of the cooling unit.

Therefore, slow streams of cooled air cool the food contact surface of the weighing platform of a weighing scale. The use of cooled air streams also eliminates or minimizes any tendency to form humid condensate, such as sweated droplets, on the cooled surfaces since ambient humid air is removed from contact with the cooled surfaces.

In a further embodiment for a meat slicer, a conduit, such as a flexible hose, supplies cool air from a remote source at a slight pressure. The sources of this cooled air may be a dedicated refrigeration unit in the base of the meat slicer itself, or a refrigeration unit within the stand upon which the meat slicer resides. Moreover, the sources of this cooled air may also be a separate heat exchanger placed inside an under cabinet cooler to transfer the lower temperature which resides in the refrigerated cabinet into the air which is circulated through the heat transfer device, without, in this case, evacuating the air in the cabinet, or a blower fan placed inside of the refrigerated space of a typical refrigerated case, such as the type found in a delicatessen or supermarket. The same blower fan may be utilized to pull chilled air from the interior of a refrigerated under counter cabinet, such as the type shown in several embodiments herein. The sources of the cooled air may also be a suction fan mounted under the slicer base, which also pulls cool air from the interior of a typical refrigerated case at a delicatessen or supermarket. The slicer motor may be designed to include a vacuum draft fan blade to pull cold air inside the slicer housing.

In the embodiment with a conduit, the base of the meat slicer is sealed to provide a pressurized cavity for entry of the cooled air. The conduit conveys cooled air from the housing cavity to a further conduit, such as a plenum, which is custom fitted around the parts of the slicer contacting the food, such as the rotating blade or the body under the blade.

The slow stream of cool air is directed further through outlets such as nozzles or vent outlets over the blade, the base extension under the blade and the carriage surfaces cooling these to a desired temperature. The frame of the meat slicer is cooled by convection from the cool air within.

For embodiments with one or more work stations, such as a cabinet with one or more cooled work surface pads, such as, for example, three, by using appropriately sized thermoelectric modules whose cold plate is attached to an underside of each work surface pad, the cooling is easily accomplished. An optional exhaust fan and one or more inlet vents can be used. The vents are used to exhaust the heat produced by the one or more thermoelectric modules inside of the cabinet comprising the one or more work station embodiment.

In this one or more work station embodiment, a switch preferably controls the power to the power supply, such as direct current, of each of the thermoelectric modules. Optionally, to minimize sweating of humid condensate, a source of cool air may be provided to slowly move through vents over the surface of each of the work station pads. In this one or more work station embodiment, the cabinet may house a refrigerated space and the side walls and counter top around the cooled work pads may be insulated. Preferably, a heat exchanger in the refrigerated space is used to supply cool dry air to the vents through a manifold. Optionally, a blower pulls ambient air through various intake means, such as sealing louvers, into the heat exchanger, where it is cooled and dehumidified and discharged under slight pressure to the manifold. Any condensate is discharged from the heat exchanger through a conduit which is then conveyed to an outlet collector, such as a drain.

Also with respect to this one or more work station embodiment, the underside of each of the work station pads may be cooled by impingement of cold ambient air inside the cabinet, as moved by moving means, such as blowers or fans, which are operated by switches. Preferably, insulated covers are provided for the cooled work surface pads, to minimize heat loss through the thermally conductive work pad material during periods of non use.

In several embodiments of the present invention, cold air streams blow over food contact surfaces. For example, as noted above, a scale may be connected by a conduit to a separate cooling accessory, or a meat slicer may use an external cool air source. Likewise, a refrigerated case can be modified to provide an easy connection for transferring cold air from the interior of the refrigerated case to a food handling device.

Likewise, the refrigeration case manufacturer can provide a port or easy connection where the food preparation device or work surface can access cool air from the interior of the refrigerated case.

However, since it is not desirable to increase exposure of food items to airborne bacteria, high efficiency particulate filter (HEPA) elements are preferably fitted either to the inlet or to the outlet vents of the cold air handlers. Therefore, by blanketing the areas with filtered cool air, the effect is a reduction of exposure of food items to airborne bacteria, since the normal ambient air with typical bacteria counts is generally excluded from the immediate affected region. It is understood that the manufacturers of the refrigerated food display cases may increase the cooling capacity of their cases to accommodate several of the embodiments of the present invention.

In a further alternate embodiment for a meat scale with a finned platform, the scale has a top surface that is not blanketed with cooling air, although cool air is used as the platform cooling medium. In this case, an air filter is not required since air only impinges the undersurface of the platform and the air exhausts at the distal end of the platform after absorbing heat from one or more fins that are part of the underside of the platform, which may be typically a cast or extruded metal platform.

In this finned embodiment, a separate source of cool air has an outlet, such as an adjustable outlet vent. Cool air is provided either by a thermoelectric module, by a conventional refrigeration unit or by a weighted outlet enclosure for an externally generated diverted supply of cool air, such as from a refrigerated case. In this finned embodiment, a diverter means, such as an extension of the platform of the scale, channels the air to a proximal end of the underside of the scale platform, where the air communicates with the one or more fins under the scale platform. Optionally, an insulated cover fits over the top of the platform in humid environments to limit any condensate from forming on the top of the scale platform surface during periods of non-use. Other insulated covers can be used to insulate the cold surfaces of the aforementioned embodiments for meat cutters or multiple work zones.

The desired location for the contact of cool air or the thermoelectric device, or devices, since more than one can be utilized on a single slicer installation, scale installation or food preparation surface, is determined by the style of the slicer and the amount of motor heat that is generated by that particular model of slicer, by the ambient temperature, and by the desire to reduce the temperature in those areas of the slicer that come in contact with food.

In further embodiments, conduit passageways may be provided within the frame of the food slicer, weighing scale or food preparation surface. The conduits may be filled with a cooling medium, such as water or other liquid non-toxic, anti-bacterial antifreeze-type coolant, and may be annexed to a coil with an adjacent refrigerated delicatessen case, wherein the coil absorbs cooled temperature to cool the cooling medium within the conduits. Optional fans or fins may be employed to facilitate the movement of chilled air and transfer of cooling from the chilled air into the cooling medium within the conduits.

In a further embodiment, the cooling medium may be cooled air drawn through one or more conduit passageways, from an adjacent refrigerator or refrigerated deli case or refrigerated slicer, weighing scale or food preparation device mounting stand or other refrigerated mounting stand holding a food handling device, to yet another food handling device.

For ease of attachment, quick disconnect couplings, ball check valves and leak monitors can be attached to the conduits. Furthermore, for a food slicer, the blade shroud may be provided with cooling medium conduit passageways, to maintain the air around the slicer blade in a desired chilled condition.

Furthermore, to enable a user to know if the sources of cooling medium are working properly, indicators of low coolant level and/or excessively high temperature level warning systems may be added, so that the devices being cooled, such as a food slicer, food weighing scale or food preparation work surface, may be shut down if an aberrant condition occurs, such as an excessively elevated temperature or an excessively low coolant level occurs. In the case of a work preparation surface, an indicator light can be used to warn the user of an excessively high temperature of the food preparation work surface.

Moreover, any cooled air passageways of the present invention may be optionally provided with filters containing clinoptilite, a naturally occurring silicate material, to lower humidity and reduce odors. Such filters may be provided wherever chilled air flows.

Any number of a combination of one or more food slicers, weighing scales or food preparation surfaces can be connected to a single source of a cooling medium, such as refrigerated delicatessen food display case. The cooling medium, which may be a non-toxic, anti-bacterial antifreeze type coolant, cooled water or a source of cooled air, may be applied singularly or in combination to the one or more food slicers, weighing scales or food preparation surfaces.

Since human beings operate manual slicers and interact with automatic slicers, it is desirable to provide an insulated handle so that the employee will not be subjected to the cold temperature of the frame. Likewise the frame can be designed to provide for the elimination or control of moisture formed by condensation on the cold frame of the slicer.

Furthermore, since it is possible that slicers may be manufactured from material other than aluminum, it should be recognized that the principles of temperature reduction that are described herein can be applied to stainless steel, plastic, and chrome plated materials as well. Other food processing equipment, such as a weighing scale, or weighing and labeling scales, can be likewise modified in design or as retrofit packages to provide the same benefits and features described above.

BRIEF DESCRIPTION OF THE DRAWINGS

The present invention can best be described in conjunction with the accompanying drawings, in which.

DETAILED DESCRIPTION OF THE DRAWINGS

Figure 1:
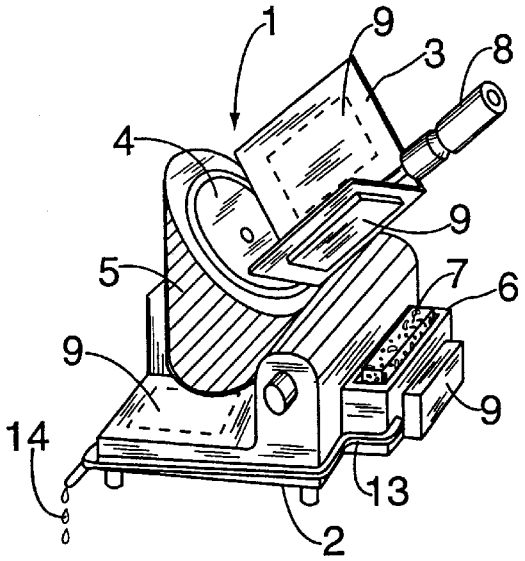
FIG. 1 is an isometric view of an embodiment of the present invention for a surface cooler for food contact surfaces of a meat slicer, shown with thermoelectric cooling.

FIG. 1 shows meat slicer 1 with a surface cooler for food contact surfaces, such as thermoelectric module 9, wherein cooling is accomplished with thermoelectric cooling. The frames of meat slicers, such as meat slicer 1, are usually made of cast aluminum. This material has good thermal conductivity and lends itself to retrofitting with thermoelectric modules 9 that can be adhesively or mechanically bonded by their cold plates to the various surfaces of meat slicer 1. Likewise, in a new model design the cold plates can be cast into the slicer frame. For example, in FIG. 1, base 2 of meat slicer 1 is shown with a thermoelectric module 9. Slicing carriage 3 is moved by insulated handle 8 for operator comfort. More than one thermoelectric module 9 may be employed. For example, FIG. 1 shows meat slicer 1 with a plurality of thermoelectric modules 9, such as two modules 9.

Figure 2:
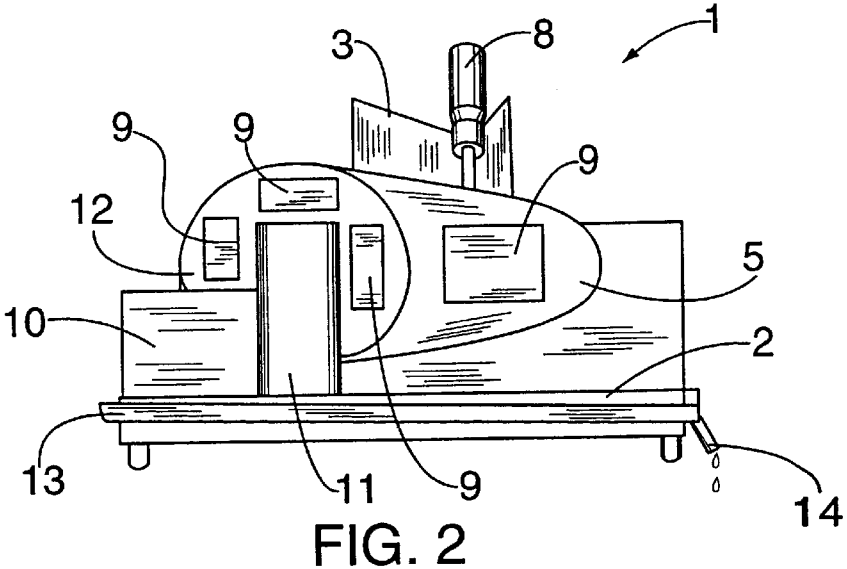
FIG. 2 is a rear view of the surface cooler for food contact surfaces of the meat slicer with thermoelectric cooling as in FIG. 1.

In one embodiment, blade 4 of meat slicer 1 is cooled by its proximity to one or more thermoelectric modules, which directly cool cutting extension 5 and blade housing 12, as shown in FIG. 1 and FIG. 2. Cutting blade 4 is shown being cooled by its proximity to three thermoelectric modules 9 on the back side of the blade cover above motor 10 and above and beside transmission housing 11. Bacteria especially tend to grow on blade 4 itself due to exposure and contact with food, such as meat juices of meat being cut. Sponge 7 is used to periodically clean blade 4 by actually slicing away a portion of sponge 7 with blade 4 of meat slicer 1. Therefore, an optional accessory to reduce bacterial growth on sponge 7 is to store sponge 7 in cooled compartment 6 with its own separate thermoelectric module 9.

Since the ambient environment may have relatively high humidity, the cooled surfaces of meat slicer 1 may tend to sweat as the moisture in the air condenses. Therefore a condensate collector, which may be provided, such as angled trough 13, encircles base 2 of meat slicer 1 and collects condensate 14 in a single location, where condensate 14 can be collected in a container, such as a transparent container, and be periodically discarded.

Condensate 14 can also be conveyed by a conduit, such as a hose, that drips directly into a drain or into the drain system that is part of many refrigerated cases.

Figure 3:
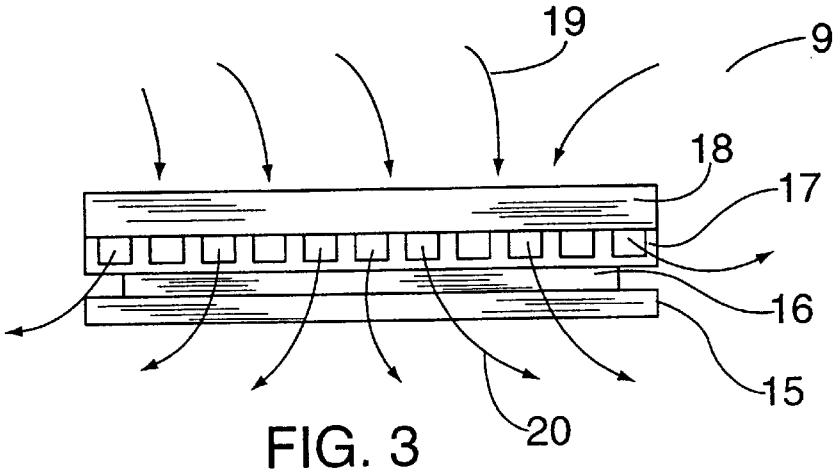
FIG. 3 is a side view of one style of a thermoelectric cooling module used as a surface cooler for food contact surfaces of a meat slicer, as in FIG. 1.

FIG. 3 shows a typical thermoelectric module 9 of the surface cooler for food contact surfaces as in FIG. 1. Thermoelectric module 9 includes preferably one or more layers with or without a pancake fan 18 as an additional layer. Cold plate 15 of thermoelectric module 9 is cooled by supplying electrical power, such as, for example, direct current, to thermoelectric layer 16, which draws heat from cold plate 15 to hot finned plate 17. In some applications, an enlarged heat sink or finned heat exchanger can be used to dissipate the heat passively to ambient air by natural convection. However, in this application, small flat fan unit 18 draws ambient air 19 and discharges heated air peripherally through fins of finned plate 17. Fan 18 insulates personnel using the device from finned plate 17 and enhances the efficiency of thermoelectric module 9. Preferably, thermoelectric units 9 used on slicing machine 1 are preferably wired in parallel to a power supply, such as a direct current low voltage power supply, which may be remotely located or placed under or adjacent to meat slicer 1. In an alternate embodiment for a cooled meat cutter, a built-in power supply compartment and switch are provided.

Figure 4:
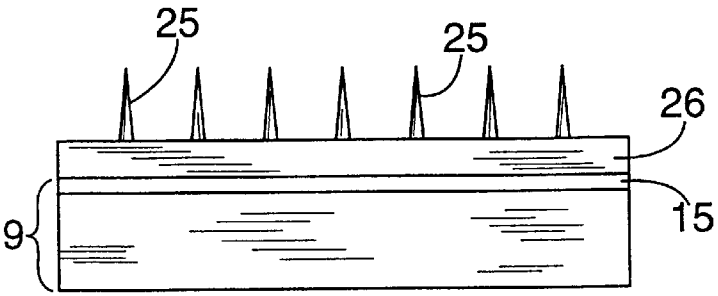
FIG. 4 is a side elevational view of a first alternate embodiment for a thermoelectric cooling module for a surface cooler for food contact surfaces for a meat cutting surface with upwardly extending spikes.

FIG. 4 shows an embodiment for a cooler for food contact surfaces of a meat cutter with a spiked plate, showing thermoelectric module 9 being used to cool spiked plate 26 with meat spikes 25. In the embodiment shown in FIG. 4, cold plate 15 of thermoelectric module 9 is bonded to spiked base plate 26. It is important to cool meat spikes 25, since meat spikes 25 are in most intimate contact with the food item, such as a slab or piece of meat. Spikes 25 themselves are cooled by conduction. It should be recognized that special thermoelectric modules may have to be provided to meet the requirements of the food service industry.

Figure 5:
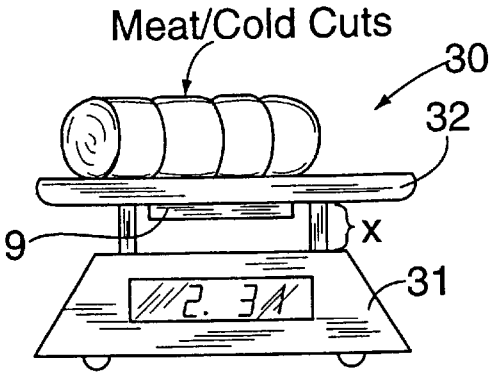
FIG. 5 is a front view of a second alternate embodiment for a surface cooler for food contact surfaces of a food scale, shown with thermoelectric cooling.

FIG. 5 shows a typical food weighing scale 30 with base 31 and food platform 32. Thermoelectric module 9 is used on the underside of platform 32 of scale 30 to cool the food contact surface by conduction. While this arrangement can be used to retrofit some scales, predetermined distance "x" must be adequate to provide clearance for thermoelectric module 9 at the highest rated item weight on scale 30. Also, the tare adjustment must have sufficient range to compensate for the weight of thermoelectric module 9.

Figure 6:
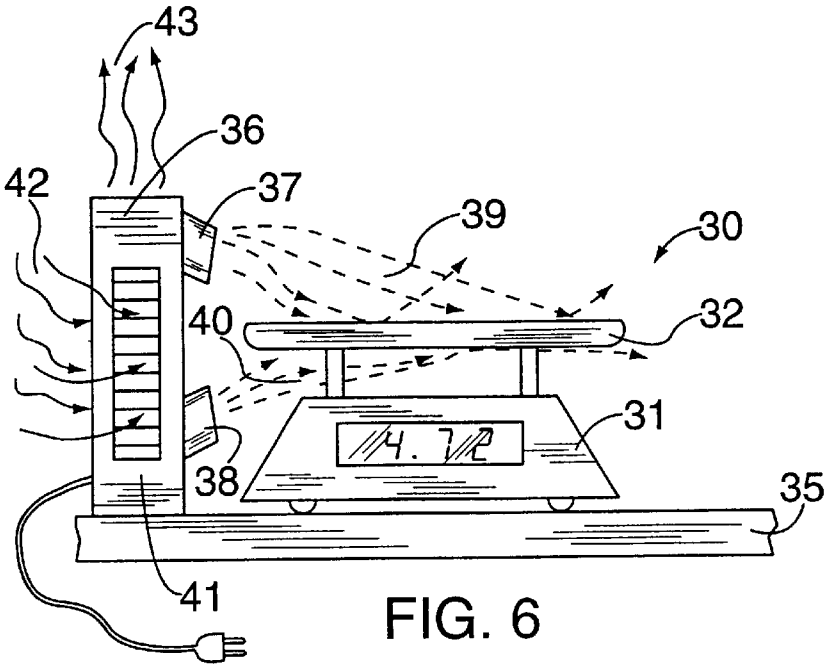
FIG. 6 is a front view of a third alternate embodiment for a surface cooler for food contact surfaces for a scale, shown with a separate cooling accessory.

FIG. 6 shows a conventional scale 30, upon a support surface 35, next to a separate cooling accessory 36. Cooling accessory unit 36 may use one or more solid state thermoelectric modules 9, or a conventional vapor compression refrigeration system, or a source of cooled air, such is found in the interior of a refrigerated delicatessen case, to provide a supply of cool air. In the embodiment shown in FIG. 6, ambient air 42 is drawn through one or more intake vents 41 and is cooled within cooling accessory unit 36. Cool air streams 39 and 40 are then discharged respectively through outlets, such as adjustable outlet nozzles 37 and 38, so that cool air streams 39 and 40 impinge on the top surface and underside of food weighing platform 32 of scale 30. Additional ambient air 42 is drawn through vents 41 to cool the condenser of a conventional refrigeration apparatus or the hot plates of thermoelectric units, such as thermoelectric units 9. Heated air 43 is then discharged through outlet vents on a top surface of cooling accessory unit 36. In this manner, slow streams 39 of cooled air cool the food contact surface of weighing platform 32 of weighing scale 30, without modifying weighing scale 30. The use of cooled air streams 39, 40 also eliminates or minimizes any tendency to form condensate (i.e. sweat) on the cooled surfaces of food support platform 32, since ambient humid air is "washed away" from contact with the cooled surface of food support platform 32.

Figure 7:
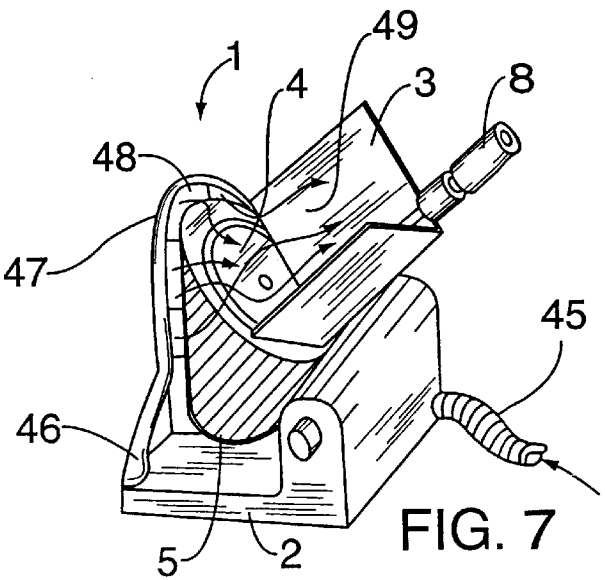
FIG. 7 is an isometric view of a fourth alternate embodiment for a surface cooler for food contact surfaces for a meat slicer, shown using an external cool air source.

FIG. 7 shows an alternate embodiment for a cooler for food contact surfaces of meat slicing machine 1, with flexible hose 45 supplying cool air from a remote source at a slight pressure. The sources of this cooled air may be a dedicated refrigeration unit in the base of the meat slicer 1 itself or in the stand or cabinet it resides on, or a heat exchanger placed inside and under cabinet cooler, or in a typical refrigerated case at a delicatessen or supermarket, or cool air pushed or pulled from the interior of a refrigerated case. In this embodiment, base 2 of slicing machine 1 is sealed, thus providing a pressurized cavity. First further conduit 46 conveys cooled air from the housing cavity to second further conduit 47, such as a plenum, which is custom fitted around blade 4 and extension 5 of slicing machine 1. Directed outlets 48, such as nozzles or vent outlets, direct a slow stream 49 of cooled air over blade 4, extension 5 and carriage surfaces 3 of slicing machine 1, thereby cooling these to the desired temperature. The frame itself of slicing machine 1 is cooled by convection from the cool air within.

Figure 8:
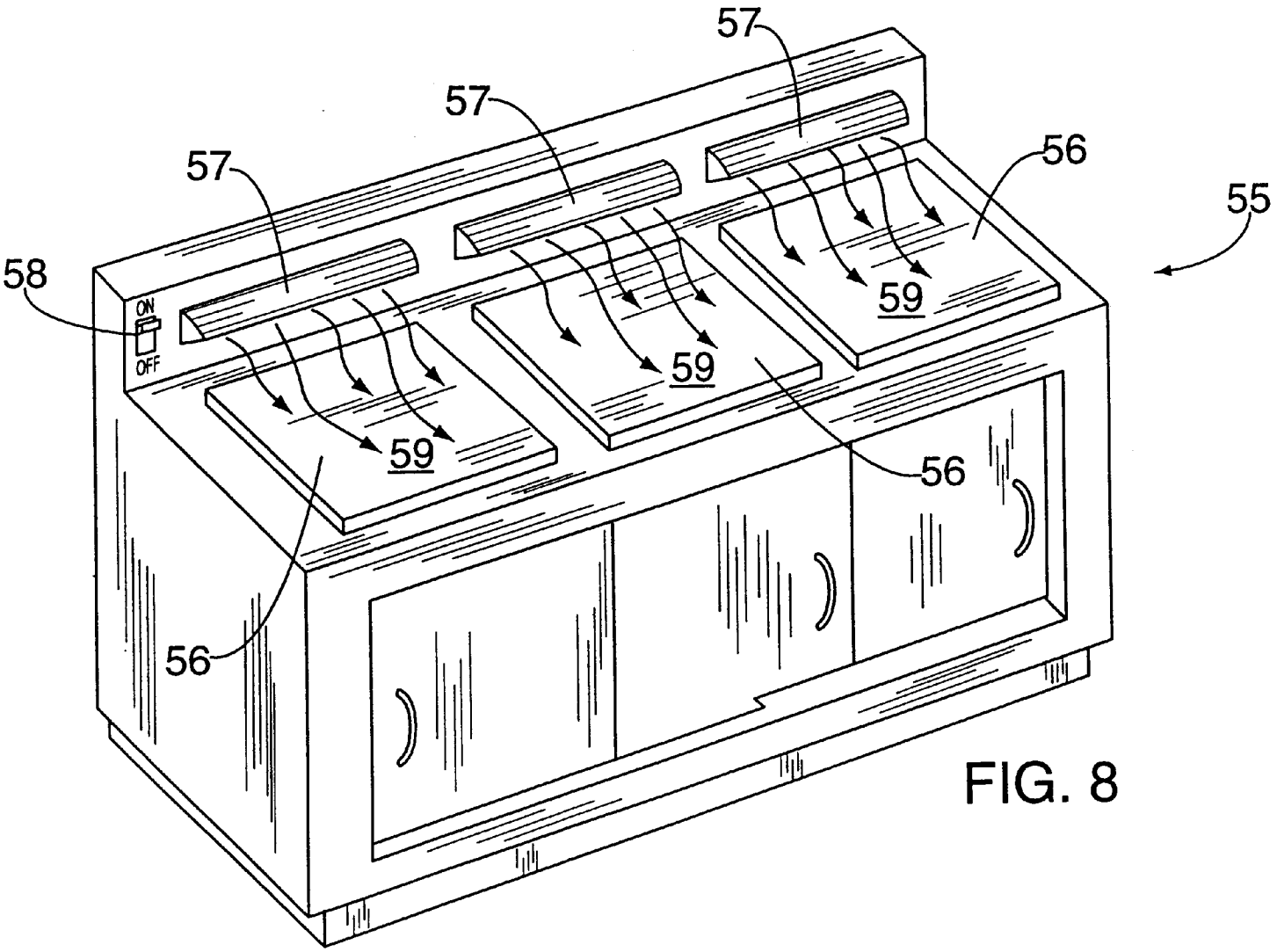
FIG. 8 is an isometric view of a fifth alternate embodiment for a surface cooler for food contact surfaces for a cabinet with a plurality of cold work zones, shown with optional air venting.
Figure 9:
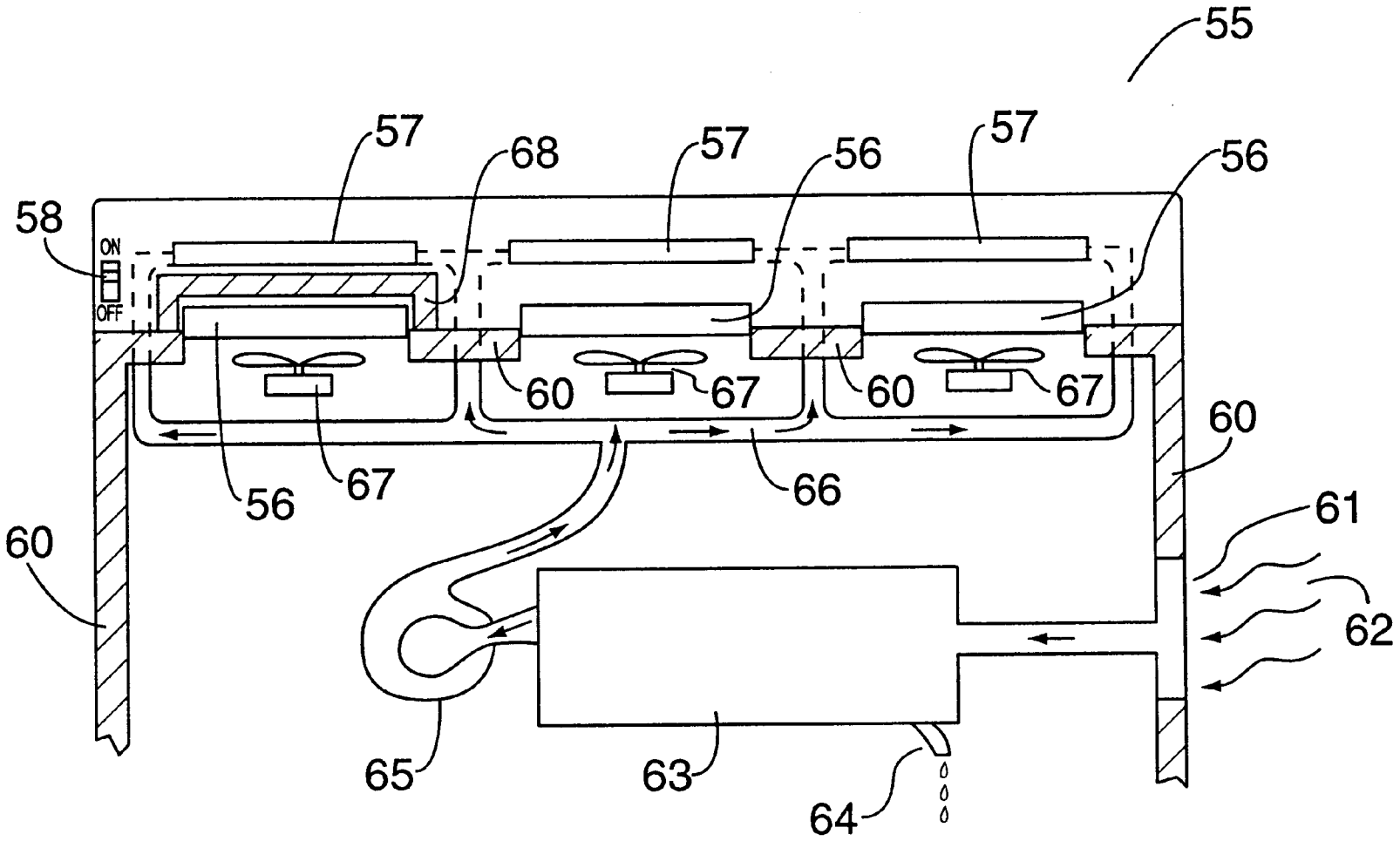
FIG. 9 is a front internal view in partial cross section of a sixth alternate embodiment.

FIG. 8 shows another embodiment for a cooler for food contact surfaces of food support device 55, such as a cabinet, with one or more, such as three, of cooled work surface pads 56. Food support device 55 can also be a table top with no cabinet underneath. By using appropriately sized thermoelectric modules, each of whose cold plate is attached to the underside of each pad 56 of food support device 55, the cooling is easily accomplished. A small exhaust fan and inlet vents can be used to exhaust the heat produced by thermoelectric modules inside food support device 55. Preferably, switch 58 controls the power to the electrical power supply, such as a direct current power supply, of the thermoelectric units (not shown). To minimize sweating, an optional source of cool dry air 59 can be slowly moved through vents 57 over the surface of pads 56. FIG. 9 is an internal view of an alternate embodiment of food support device 55 shown in the previous FIG. 8. In this embodiment, food support device 55 houses a refrigerated space and the side walls and counter top around cooled work pads 56 are insulated by insulation 60. Heat exchanger 63 in the refrigerated space is used to supply cool air to vents 57 through manifold 66. Blower 65 pulls ambient air 62 through sealing louvers 61 into heat exchanger 63, where air 62 is cooled, dehumidified and discharged under slight pressure to manifold 66. Condensate is discharged from heat exchanger 63 through conduit 64, which is then conveyed to a collector, such as a drain. The underside of each pad 56 is cooled by impingement of cold ambient air inside food support device 55 is moved by fans 67. Insulated covers 68 are provided for cooled work surface pads 56 to minimize heat loss through the each thermally conductive work pad 56 during periods of non use. Switch 58 operates blower 65 and fans 67. In several embodiments, optional cold air streams are shown blowing over food contact surfaces. This includes FIG. 6 showing a scale with a separate cooling accessory, a meat slicer in FIG. 7 using an external cool air source, and the cooled work zones of FIGS. 8 and 9.

Since it is not desirable to increase exposure of food items to airborne bacteria, high efficiency particulate filter (HEPA) elements may be preferably fitted either to the inlet or to the outlet vents of the cold air handlers (not shown). In this manner, by blanketing the areas with filtered cool air, the effect is a reduction of exposure of food items to airborne bacteria, since the normal ambient air with typical bacteria counts is generally excluded from the immediate region.

Figure 11:
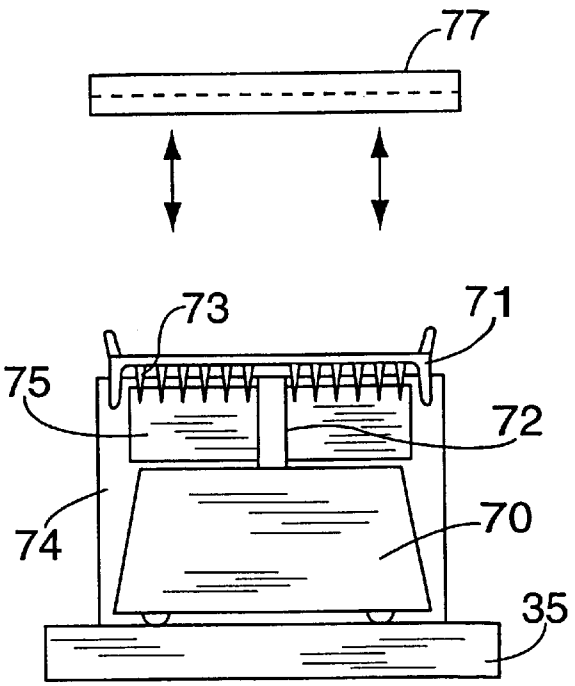
FIG. 11 is a side view of the seventh embodiment for a surface cooler for food contact surfaces for a finned platform scale.
Figure 10:
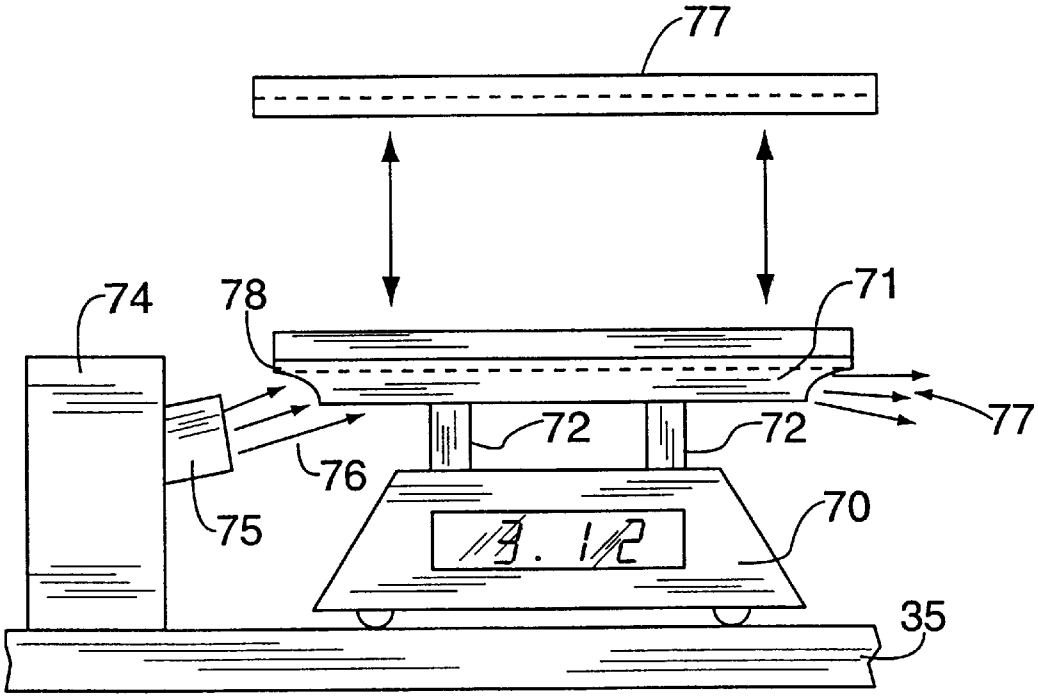
FIG. 10 is a front view of a seventh embodiment for a surface cooler for food contact surfaces for a finned platform scale.

FIG. 10 shows a front view of a scale 70 with a finned platform 71. This alternate embodiment, also shown in a side view in FIG. 11, has a top surface that is not blanketed with cooling air, although cool air is used as the cooling medium for platform 71. In this case, an air filter is not required since air 76 just impinges the undersurface of platform 71 and exhausts at the distal end 77 after absorbing heat from fins 73 that are part of the cast or extruded metal platform 71. Supports 72 are used to attach the platform 71 to weighing scale 70. A separate source of cool air 74 has adjustable outlet vent 75. This may be thermoelectric module 9, or conventional refrigeration unit or simply a weighted outlet enclosure for an externally generated supply of cool air, such as from the interior of a refrigerated case. Extension 78 of platform 71 helps to channel air 76 to the underside of platform 71 where it communicates with fins 73. An insulated cover 77 that fits over the top of platform 71 may be used in humid environments to limit any condensate from forming on the top surface of platform 71 during periods of non-use. This same technique of using insulated covers can be used to advantage on the other equipment, such as cold surfaces such for the meat cutters or work zones.

Figure 12:
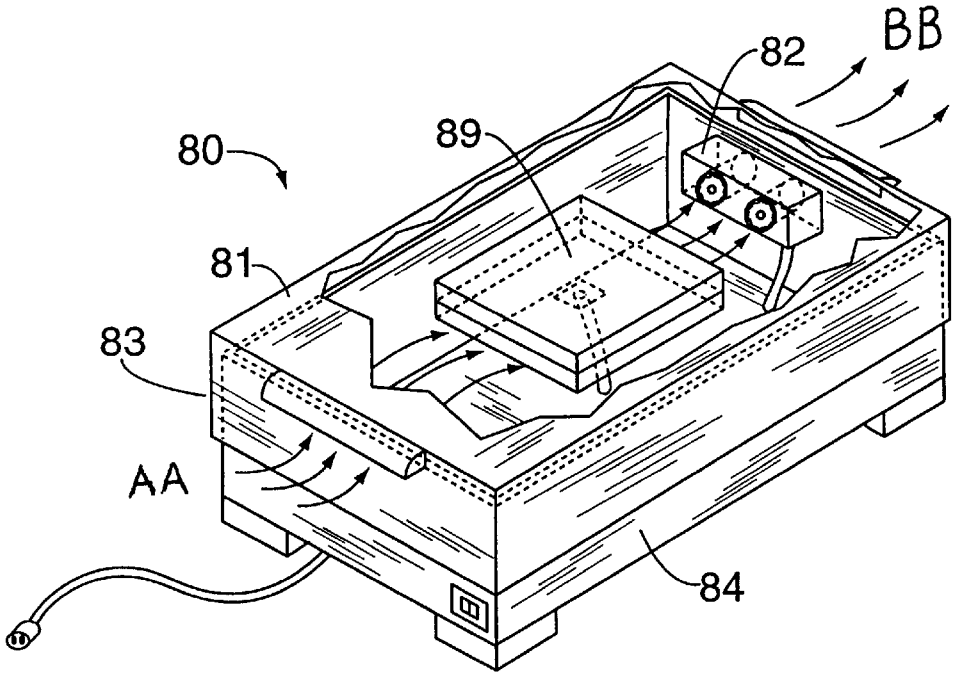
FIG. 12 is a perspective view in cut away of an eighth embodiment for a portable food preparation work station.

FIG. 12 is an embodiment of a portable food preparation work station 80 that utilizes one thermoelectric module 89 for cooling of the upper food work surface area 81. Air is drawn into a hollow interior of food preparation work station 80 in the direction indicated by arrows "AA", is exposed to thermoelectric module 89 and exits food preparation work surface 81 in the direction indicated by arrows "BB". In this embodiment the thermoelectric module 89 does utilize a cooling fan 82. The upper half 83 of the enclosure can be removed for access to the electrical components. The upper lid structure slides over the bottom pan structure 84 with a water tight seal filling the space between the two structures. In another embodiment the entire base assembly can be constructed as a large heat sink with fins that allow the heat generated by the thermoelectric module to be dissipated by convention and conduction. It is contemplated that multiple thermoelectric modules can be utilized and the entire box could be made water tight without need for a cooling fan that would exhaust the heat generated by the thermoelectric module to the outside.

Figure 13:
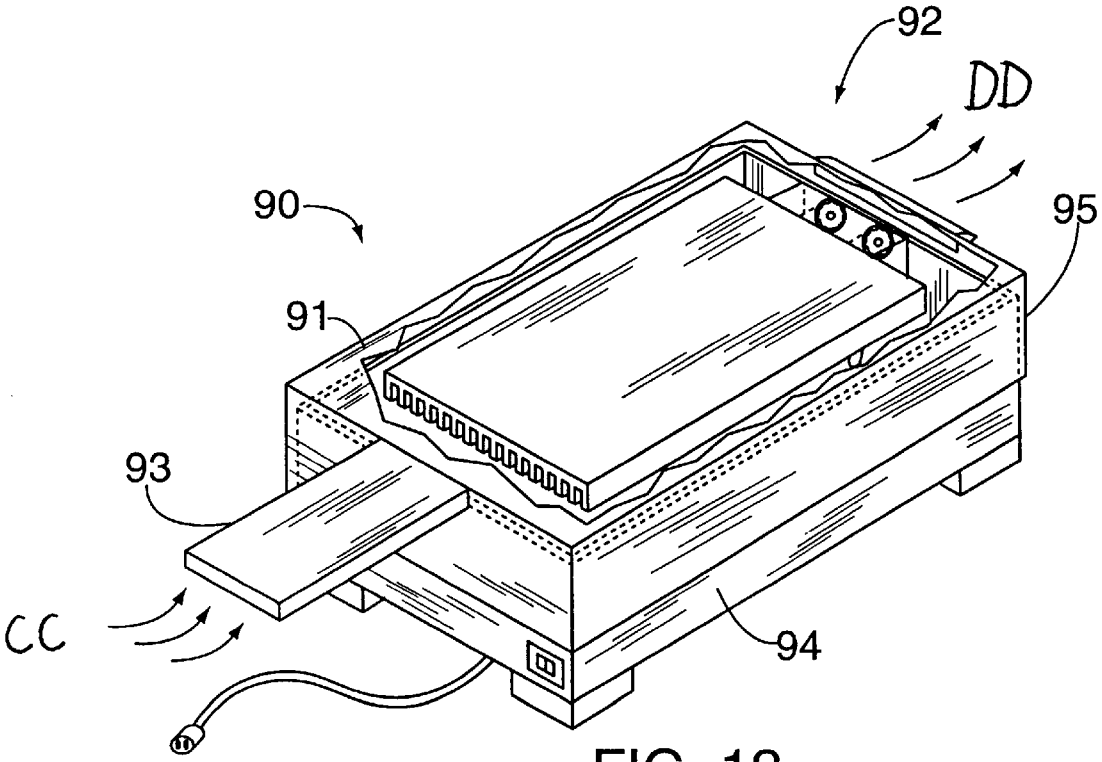
FIG. 13 is a perspective view in cut away of a ninth embodiment for a portable food preparation work station.

FIG. 13 is an embodiment of a portable food preparation work station 90 that utilizes cool air as pulled from the interior area of a refrigerated case into conduit 93 and then into work station 90. The upper half 91 of the enclosure 90 can be removed for access to the interior components, such as the suction fan 92. The upper lid structure 91 slides over the bottom pan structure 94 with a water tight seal 95 filling the space between the two structures 91, 94. Bottom pan structure 94 is manufactured from a non-conductive material so as to minimize the potential for condensation forming on the outer walls of the structure 90. This also serves to conserve the cooling energy needed to cool the upper surface of upper lid structure 91. Air is drawn into a hollow interior of food preparation work station 90 in the direction indicated by arrows "CC" (from the interior of a refrigerated case, such as refrigerated case 1001 in FIG. 26) through entrance conduit 93, is then directed through fins 99, to cool upper half 91 of food preparation work surface work station 90 and exits food preparation work surface work station 90 in the direction indicated by arrows "DD".

Figure 14:
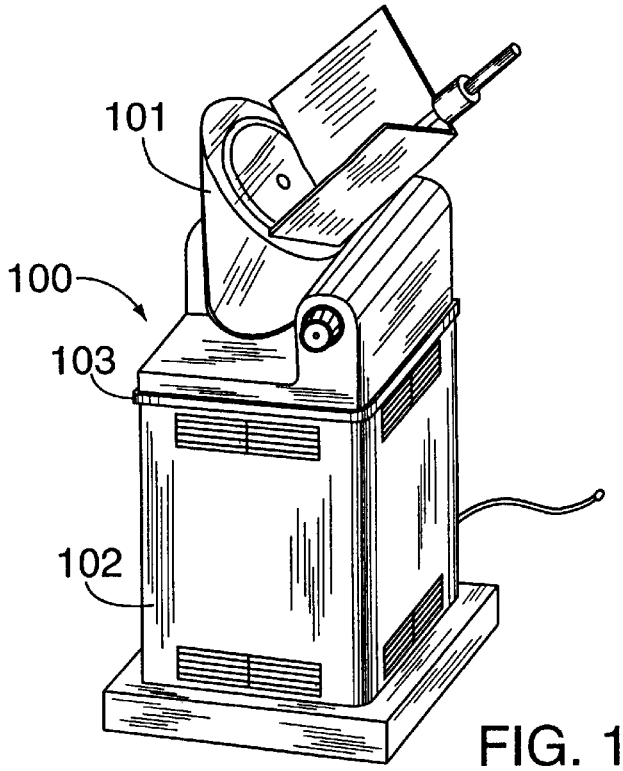
FIG. 14 is a perspective view of a tenth embodiment for a food slicer with a mounting stand and source of refrigeration therein.

FIG. 14 is an embodiment of a single slicer mounting stand 100 that contains its own source of refrigeration. In this embodiment the meat slicer 101 sits on top of a cabinet style enclosure 102 that has its own seal 103 around the upper lip to engage the base of the slicer 101 such that there now exists an air tight seal between the slicer 101 and the cabinet 102. This allows the refrigerated air that is produced by the refrigeration equipment mounted inside of the cabinet 102 to be pushed or pulled into contact with the underside of the slicer 101 such that the slicer frame can be cooled, as noted before in the description of the embodiment shown in FIG. 7 and wherein a slicer is modified to include air passageways for cooled air therethrough. In this embodiment of FIG. 14, a single slicer frame is shown residing on the cabinet 102. Multiple slicers 101 can also be located on a single mounting stand 102 and mounting stand 102 can optionally also provide storage of a slicer sponge and can store food preparation utensils, such as a trim knife.

Figure 15:
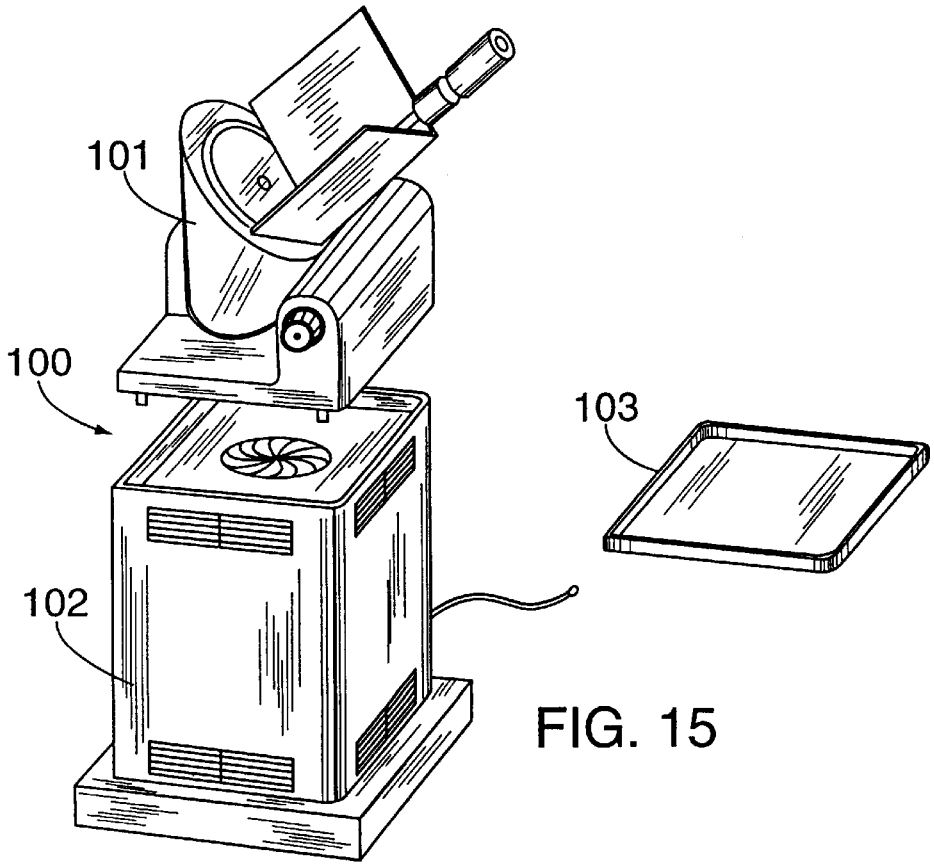
FIG. 15 is a perspective view of the food slicer as in FIG. 14, showing the seal utilized therewith.

FIG. 15 provides a view of seal 103 that may be utilized between the slicer 101 and the slicer mounting cabinet stand 102. Optionally, a heat exchanger can also be mounted in a cabinet style enclosure 102 and the slicer or slicers can work in concert with an existing refrigeration case )not shown).

Figure 16:
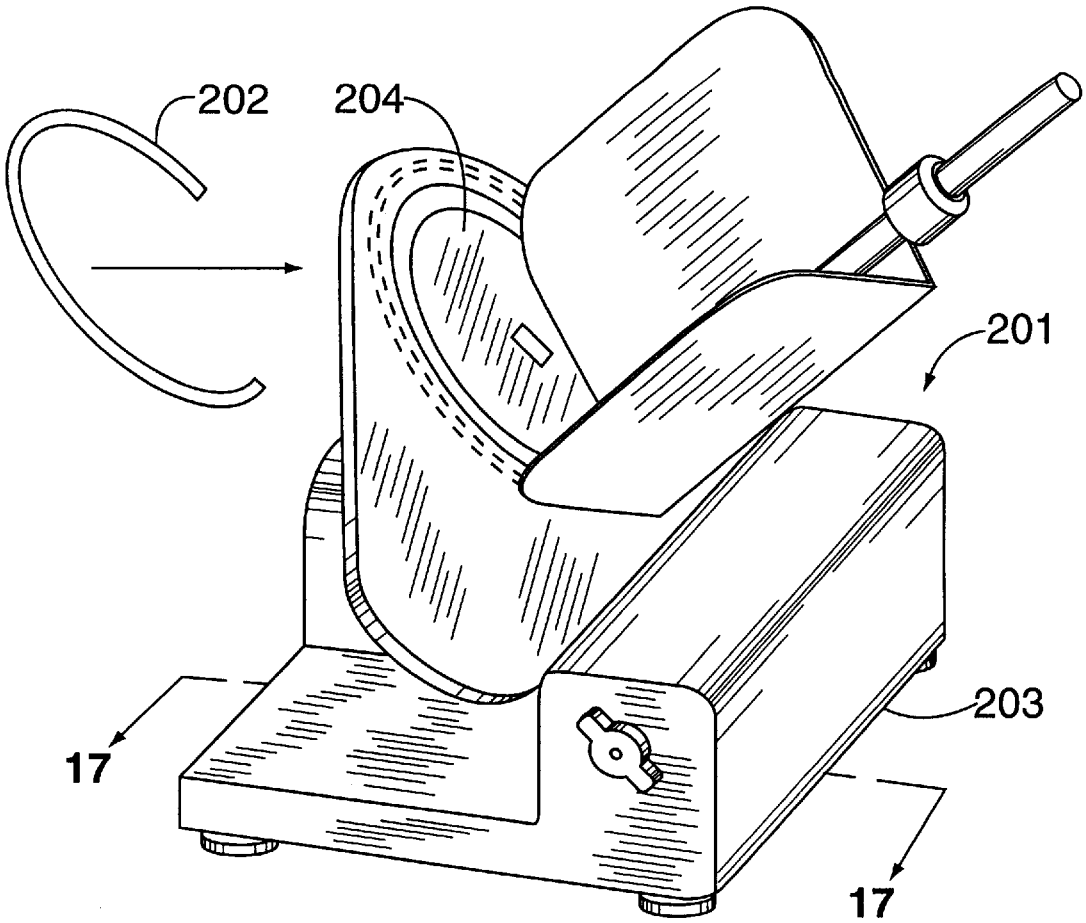
FIG. 16 is a perspective view of an eleventh embodiment of the present invention, wherein cooling medium-filled conduit passageways are provided within the frame of a meat slicer.
Figure 17:
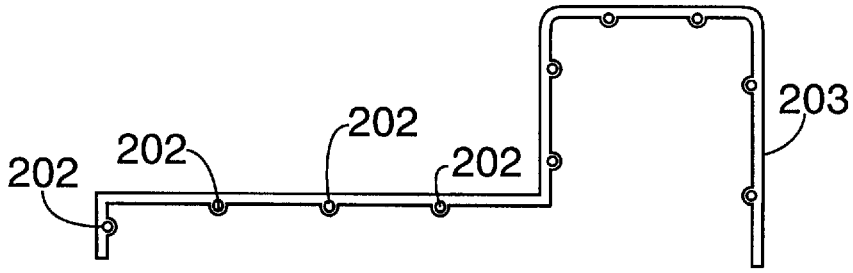
FIG. 17 is a cross sectional view thereof, taken along line 17—17 of FIG. 16, wherein the cooling medium conduit size includes a cross section size which is larger for use with chilled air as a cooling medium and wherein further the cooling medium conduit size includes cross sectional diameter which is relatively small for use with liquid coolant. For example, the liquid coolant passageway size could be ⅜ inch diameter (internal diameter) tubing and the air passageway size could be one square inch. Both are dependent upon the size of the device to be cooled, the number of devices to be cooled and the desired flow rate of the air or liquid coolant cooling medium.

FIGS. 16 and 17 reflect modifications of cooling medium conduit passageways 202 within an existing manual or automatic food slicer 201, such as a meat and cheese slicer or incorporation into a newly designed meat and cheese slicer, such that the addition of, or attachment to, or mounting on top of a subframe, of passageway 202, brings about a temperature reduction to the slicer 201 itself. The cooling medium conduit size includes a cross section diameter which is larger for use with chilled air as a cooling medium and wherein further the cooling medium conduit size includes cross sectional diameter which is relatively small for use with liquid coolant. For example, the liquid coolant passageway size could be ⅜ inch diameter (internal diameter) tubing and the air passageway size could be one square inch. Both are dependent upon the size of the device to be cooled, the number of devices to be cooled and the desired flow rate of the chilled air or liquid coolant to be used as the cooling medium.

This reduction in temperature is sufficient to reduce the overall temperature of the slicer body frame 203 and the slicer blade 204 itself, equal to or below the temperature that is specified for refrigerated food storage or at any other temperature below the ambient temperature. Such temperature may not be as low as the temperature prescribed as suitable of perishable food storage but such reduced temperature in the areas where food comes in contact with the slicer is sufficiently low enough to reduce the amount of bacteria that grows on the slicer body 203 and the slicer blade 204 or upon areas of a food weighing scale (not shown) that come in contact with food, or the work surface area of a food preparation table such as the type is described herein.

As noted before, bacteria grows on the slicer body 202 and slicer blade 204, or upon a weighing scale platform, or upon the surface of a food service work top, due to the meat juices and food debris deposited on the slicer 201 following the act of cutting or slicing meats and or cheeses, or on the scale after weighing if the food contacts the scale and likewise on the work surface when food is being prepared, such as making sandwiches with sliced meats or cheeses. A number of methods can be employed to accomplish the reduction in temperature of the slicer frame, and slicer blade.

For example, as shown in FIGS. 16 and 17, one method is the use of liquid tight passageways 202 which are part of the equipment or device to be cooled, which when a cooling medium, such as water, or a non-toxic, anti-bacterial antifreeze type coolant, is pumped or otherwise conveyed through passageway 202, to provide the transfer of cooling to the slicer 201, scale, work top, or other equipment to be cooled.

As shown in FIG. 17, when viewed in cross section, along line 17—17 of FIG. 16, the diameter of the passageway depends on whether the cooling medium is air or a liquid non-toxic, antibacterial antifreeze type coolant.

For example, the cooling medium conduit size includes a cross section diameter which is larger for use with chilled air as a cooling medium and wherein further the cooling medium conduit size includes cross sectional diameter which is relatively small for use with liquid coolant. For example, the liquid coolant passageway size could be ⅜ inch diameter (internal diameter) tubing and the air passageway size could be one square inch. Both are dependent upon the size of the device to be cooled, the number of devices to be cooled and the desired flow rate of the chilled air or liquid coolant to be used as the cooling medium.

Conduit passageways 202 can be used for air, liquid coolant, such as liquid non-toxic antibacterial antifreeze type coolant, or for any other liquid, air or gas, that can be used to transport heat for the purpose of temperature change.

Such modifications may be part of the scale, slicer, or work top when they are manufactured or they could be installed as an after market retrofit package.

Figure 18:
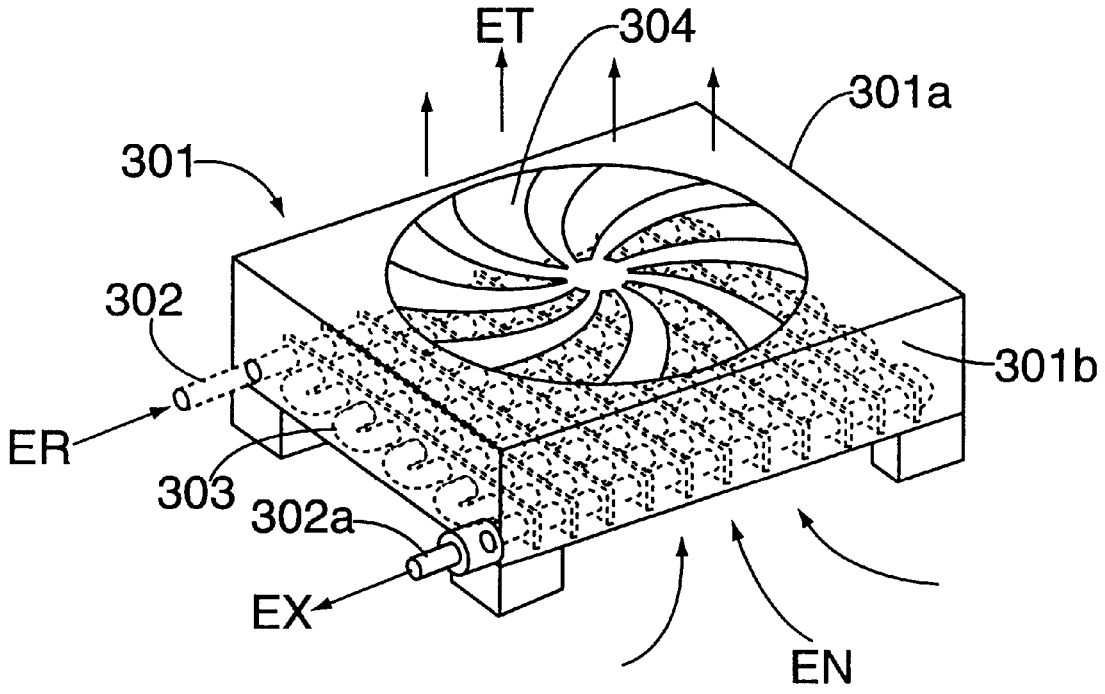
FIG. 18 is a perspective view of a twelfth embodiment of a heat conversion device for use in conjunction with a refrigerated deli case or similar device. This embodiment is shown with an optional finned coil and water pump added to facilitate the movement of chilled air and transfer of cooling, from the chilled air into the cooling medium within the conduits, which is transported to the intended device to be cooled.
Figure 26:
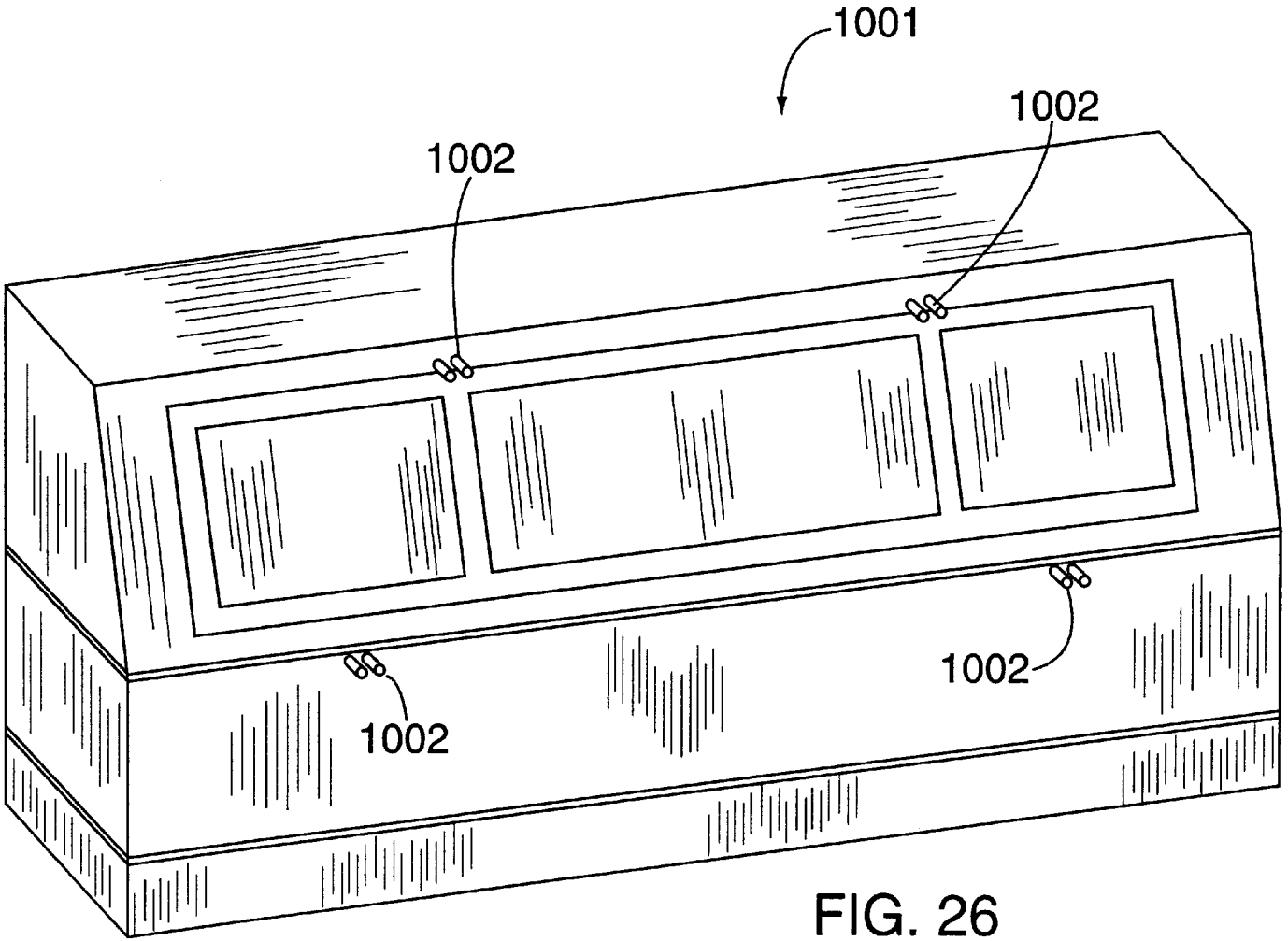
FIG. 26 is a perspective view of a sixteenth embodiment for a refrigerated case with cooling medium conduit ports therein.
Figure 31A:
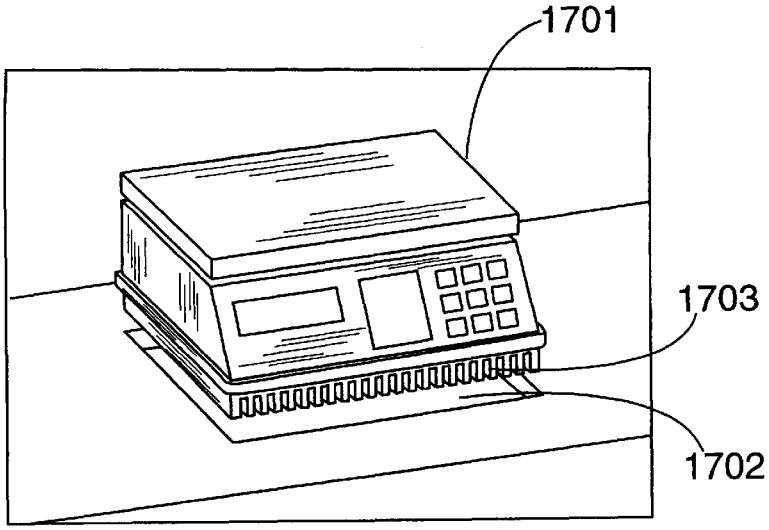
FIG. 31A is a close up perspective view of the weighing scale of the refrigerated food display delicatessen case of FIG. 31.
Figure 31:
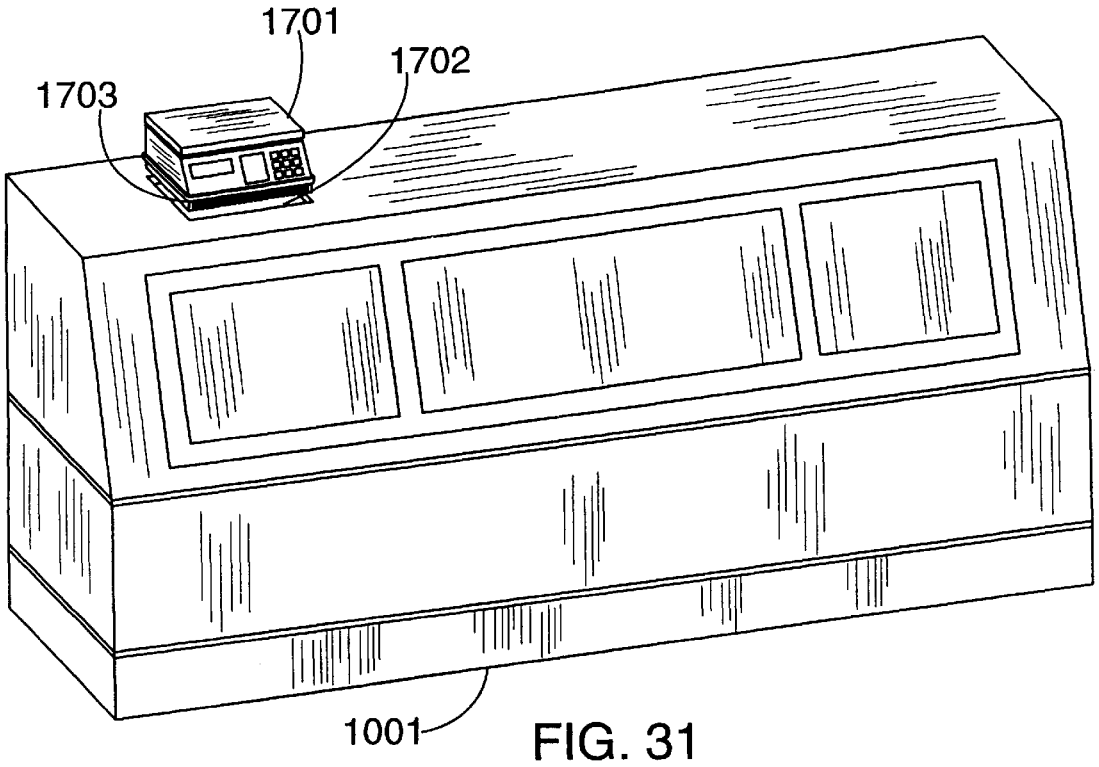
FIG. 31 is a perspective view of a twentieth embodiment for a refrigerated food display delicatessen case, shown with a weighing scale connected to a cooling medium therefrom.

In one embodiment shown in FIG. 18, a heat conversion device 301 (such as a heat exchanger) may be located inside of a stand alone box type housing 301*a*, which, when placed inside of a refrigerated food case 1001, such as shown in FIG. 26 or FIG. 31 herein, for example, allows the chilled air inside of the refrigerated food case 1001 to be drawn through the housing 301*a* across the heat conversion device 301, which can optionally have fins for efficient heat transfer and which may transfer t he chilled temperature of the ambient air into the liquid cooled medium contained inside of the conduit passageways 302 therein.

An air-fillable hollow conduit passageway 301*b* may be used to direct the chilled air that resides in the interior of a refrigerated food display case over the optionally finned coils 303 that hold the liquid cooling medium, such as liquid non-toxic, anti-bacterial antifreeze type coolant, or water which enter heat conversion device 301 through tubing passageway 302, (in the direction indicated by directional arrow "ER") and exit heat conversion device 301 through tubing passageway 302*a* (in the direction indicated by directional arrow "EX"). The heat conversion device 301 may have a fan 304 to move the chilled air into housing 301*a* (as indicated by the directional arrows "EN") through hollow interior passageway 301*b* (as indicated by the directional arrows "EN") over back and forth looped coil 303 that contains the cooling medium. Air flow "EN" exits as directional arrows "ET". Hollow interior passageway 301*b* may have fins (not shown) attached to the tubing coils 303 to aid in the transfer of the lower temperature chilled air (shown by directional arrow "EN") to the relatively warmer coolant entering via conduit passageway 302 (as shown in directional arrow "ER"), and moved through coil 303 stored in the hollow interior passageway 301*b*, so that the coolant which exits coil 303 via exit conduit 302*a* (in the direction of arrow "EX") is cooler.

Therefore, after the liquid cooling medium is pumped or otherwise conveyed through the coil 303 of heat transfer device 301, the cooling medium inside of the coil 303 and exiting conduit 302*a* is chilled and its temperature is lowered significantly. Then, in one embodiment, it is the chilled cooling medium, such as water, or a non-toxic, anti-bacterial antifreeze type coolant, which is routed under pressure from exit conduit 302*a* through a meat slicer or weighing scale body or food preparation work surface. Since most meat slicers, such as slicer 201 are cast aluminum, the transfer of the chilled temperature of the cooling medium to the warmer temperature of the meat slicer 201 is enhanced by the conductive properties of aluminum. Attachment of copper or aluminum tubing or any other highly conductive material to the aluminum frame of the slicer 201 or scale to facilitate the transfer of temperature can readily be accomplished. Likewise it is possible to cast cooling passageways 202 into the frame 203 when it is newly manufactured. Since the transfer of cooling to the slicer 201 or scale frame gives off no heat (except by the liquid cooling medium pump which can be externally located), a retrofit package can be provided so that a preexisting slicer can be updated in the field without great difficulty.

Moreover, while a weighing scale is generally made of a less conductive material such as stainless steel, the transfer of a cooler temperature can also occur.

Figure 19:
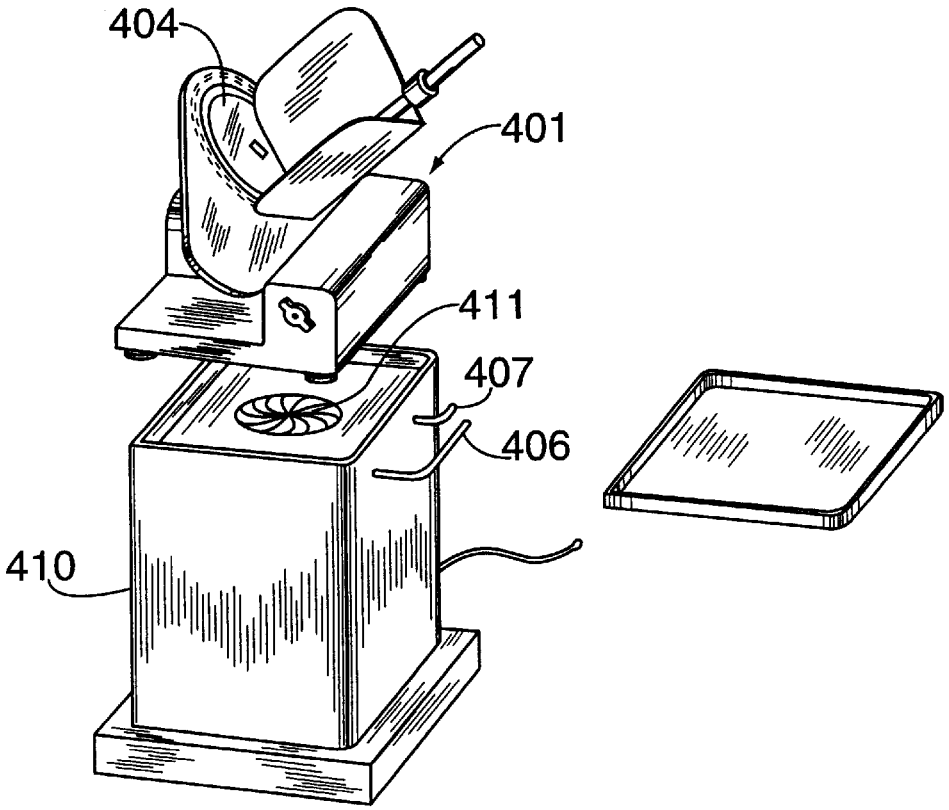
FIG. 19 is a perspective view of a thirteenth embodiment for a food slicer stand with a sealed fan/blower in a base therein to push chilled air upward to the food slicer.
Figure 20:
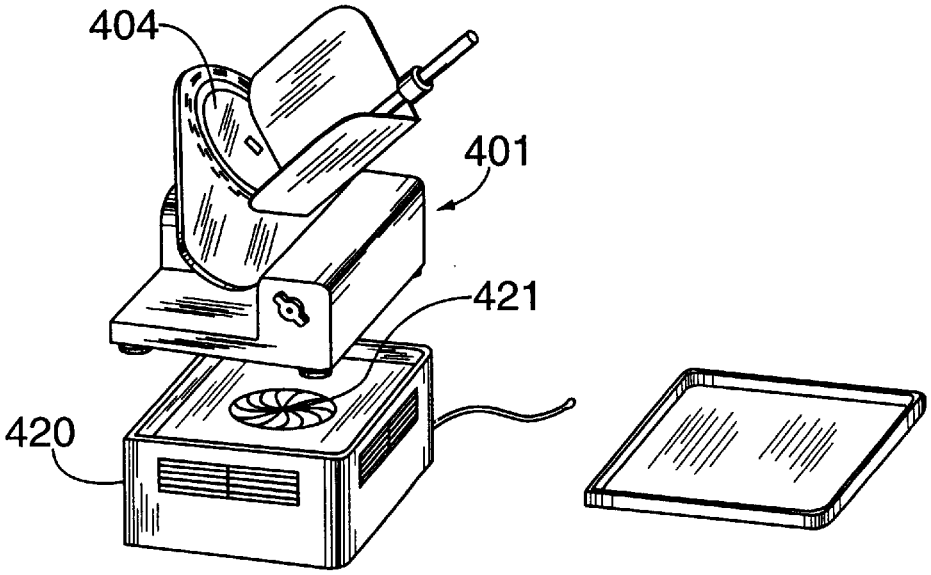
FIG. 20 is a perspective view thereof with auxiliary heat exhaust ports within the portable heat exchanger, or self contained refrigeration system, food slicer, weighing scale or food preparation work surface mounting stand.

As shown in FIGS. 19 and 20, in another embodiment, a free standing cabinet 410 or 420 or counter top slicer platform or scale mounting platform, or counter top work surface, can easily be outfitted with a heat conversion device 301, such as a heat exchanger, as in FIG. 18, (used in reverse), which can transfer the chilled temperature of the cooling medium within coil 303 therein, such as water or non-toxic, anti-bacterial antifreeze type coolant, back to the air surrounding the hollow passageway 301*b* of heat conversion device 301. The cooled air, when circulated in the vicinity of the coil 303 could be pushed by fan or blower 411 or 421 into the base of the slicer 401 or the scale or food processing work surface.

Figure 21:
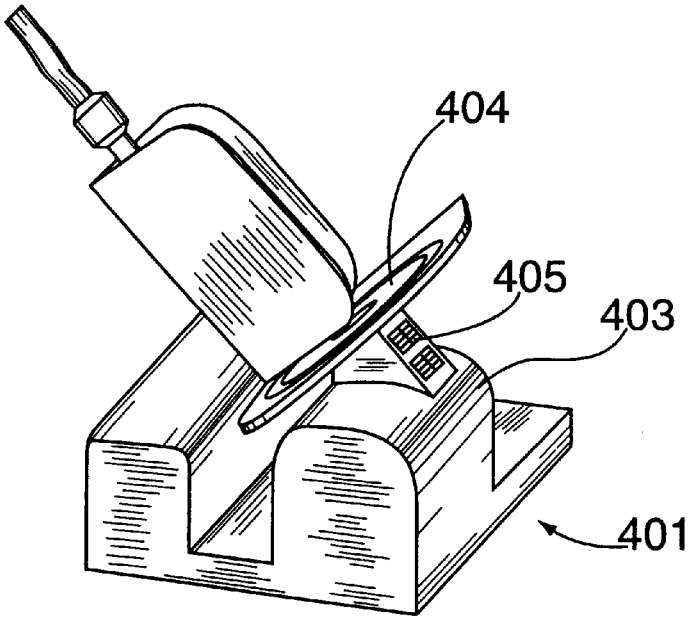
FIG. 21 is a perspective view of a fourteenth embodiment of the present invention for a food slicer with heat exhaust ports therein.

As shown in FIG. 21, since the slicer 401 with blade 404 itself is a source of heat it may be desirable to provide exhaust ports 405 in the slicer 401 so that when using forced air such as in FIGS. 19 and 20, the air can be exhausted through ports 405 that are provided in the slicer frame 403. Optionally it may be desirable to provide for the exhaust of motor heat at the same time that provisions are made for the pushing or pulling of cooled air into the slicer frame. Likewise it may desirable to have a pump, which moves the cooling medium through the slicer frame 403, to be outfitted with a fan blade such that the pump also moves the chilled air into the slicer frame, which in turn exhausts the motor heat out of the slicer frame.

It may likewise be desirable to have the motor which drives the slicer blade also drive a fan motor which could be used to pull air out of the cavity formed by the slicer housing stand 410 or 420.

A single slicer stand, cabinet, or work platform could provide the pump mechanism, the air handling and the exhaust mechanisms and or an entire refrigeration system (such as a compressor driven system) as described above for one or more slicers 201 or 401, scales, or food handling work surfaces, that can be connected in various combinations so that the user is free to provide different configurations which are easily added to or subtracted from at the users convenience.

As shown in FIG. 19, such a system could have cooling medium outlets 406 and intake ports 407 for more than one device such as a slicers, scales, and food handling work surfaces.

Figure 22A:
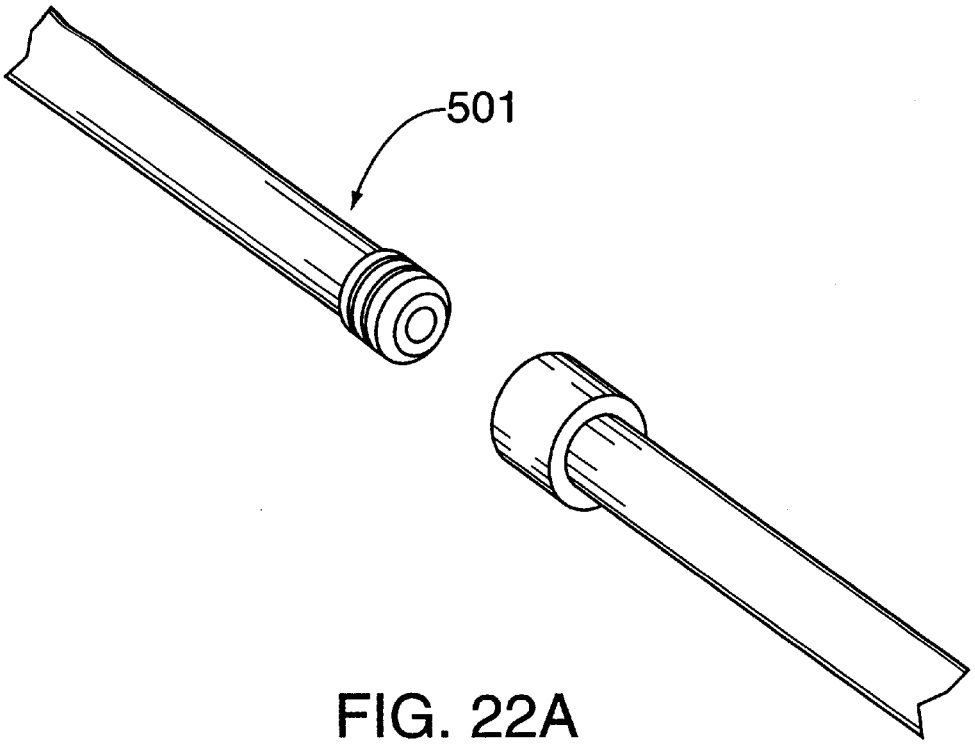
FIG. 22A is a close up perspective view of quick disconnect couplings used optionally in the present invention.
Figure 22B:
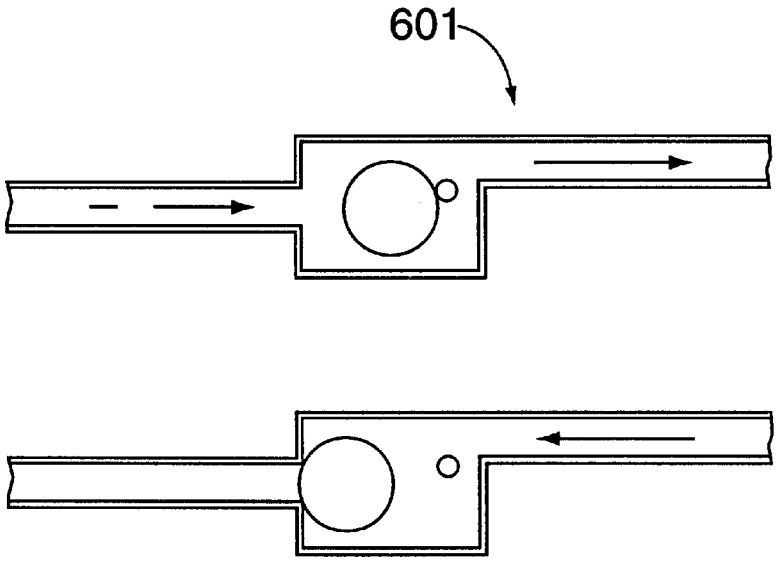
FIG. 22B is a close up side sectional view of a ball check valve used optionally in the present invention.

Optionally, as shown in FIG. 22A, this system would have quick disconnect couplings 501 for ease of attachment of liquid or air cooling medium conduits to slicer 201 or 401, weighing scale or other food preparation devices. It is also envisioned that simple ball check valves 601 can be provided to prevent backflow when various devices are connected or unconnected to the chilled cooling medium system, and that various flow valves and or system monitors could be provided to alert the user that a leak has been detected. Quick disconnect couplings 501, backflow check valves 601 and leak monitoring devices are commonly used and well established devices.

Other monitors (not shown) may be appropriate to enable a user to know if the sources of cooling medium are working properly, indicators of low coolant level and/or excessively high temperature level warning systems may be added, so that the devices being cooled, such as a food slicer 201 in FIG. 16, food weighing scale, such as food weighing scale 1701 in FIG. 31A or food preparation work surface, such as food preparation work surface 80 in FIG. 12, may be shut down if an abnormal condition occurs, such as an excessively elevated temperature or an excessively low coolant level occurs. In the case of a work preparation surface 80, an indicator light (not shown) can be used to warn the user of an excessively high temperature of the food preparation work surface.

The newly designed slicer 201 or the existing slicer that is modified includes one or more passageways 202, which are used to transmit the chilled cooling medium. Passageways 202 may be a separate tube, or may be molded-in or cast-in passageways.

A cooling medium handling pump may be located in the interior of a refrigerated deli case, in the base of the slicer or scale, in the cabinet base 401 such as in FIG. 19, in the platform base 420 such as shown in FIG. 20 or in a stand alone pump station, or in the heat exchanger, such as is shown in FIG. 18, or in any other location which would optimize the flow of the cooling medium.

Figure 25:
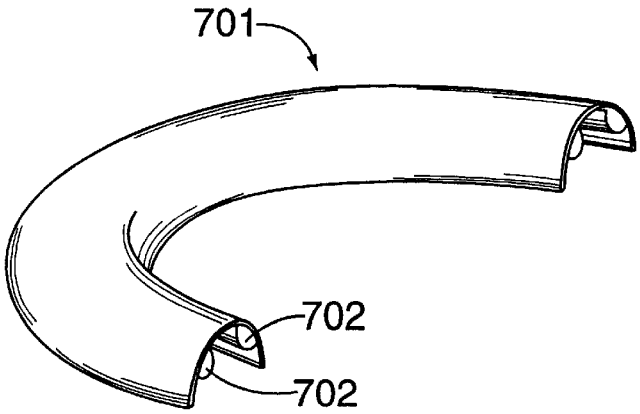
FIG. 25 is a perspective view of a food slicer blade shroud with a liquid or air cooling medium conduit passageway provided therein.

As shown in FIG. 25, likewise a blade shroud 701 can be provided which has cooling medium passageways 702 routed through it. Shroud 701 can be attached as a after market device.

Figure 23:
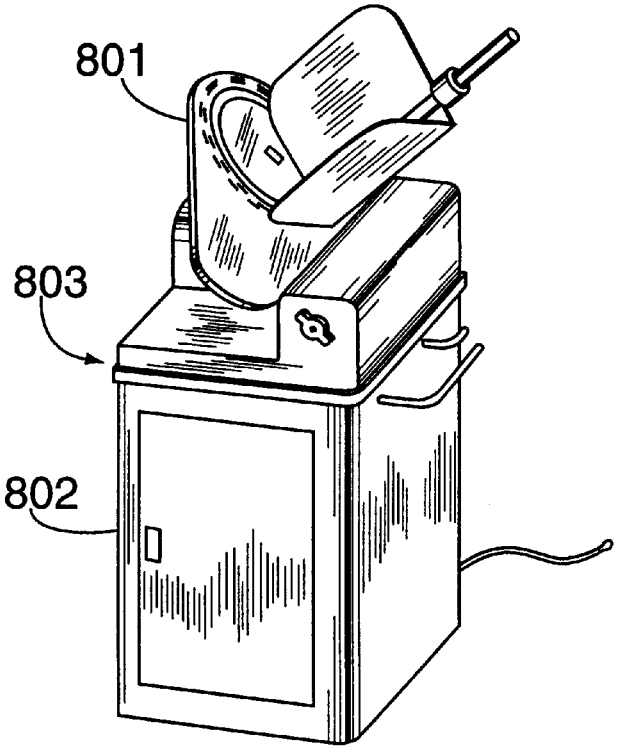
FIG. 23 is a fifteenth embodiment of the present invention with a seal provided between a food slicer and a mounting stand.

As shown in FIG. 23, a commonly used small compressor driven under counter refrigerated cooler 802 can be utilized to provide refrigerated cooling space as well as provide the cooling system to chill the liquid that is pumped through the slicer 801 or scale. Such a cooler 802 would have to be modified so that the slicer 801 or other food handling devices can be connected to allow the flow of the chilled cooling medium from the small refrigerator of cooler 802 into the slicer 801 that is to be cooled. Optionally a seal 801 may be provided to improve the thermal efficiency of the entire heat transfer system.

Figure 24:
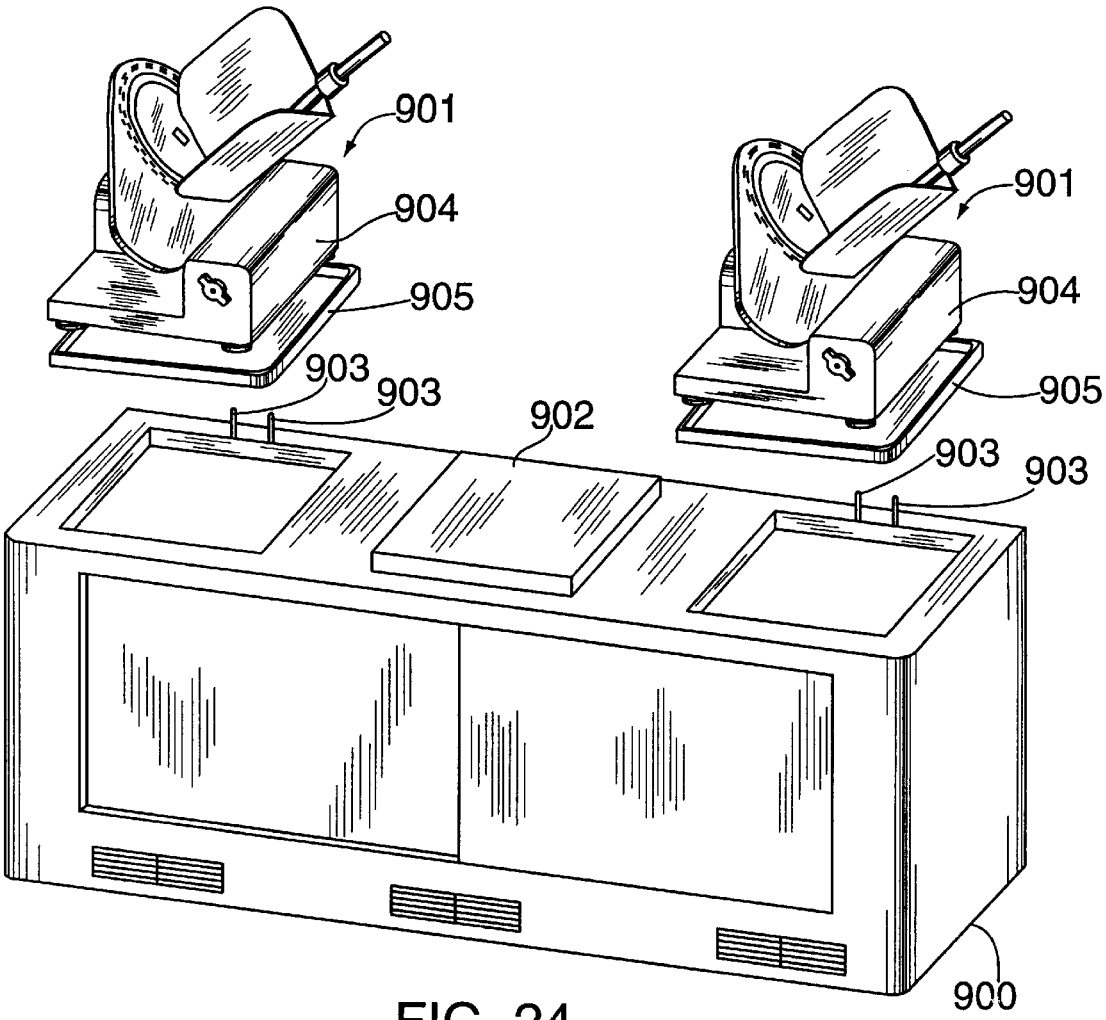
FIG. 24 is a perspective view of a sixteenth embodiment for a stand for multiple food slicers.

As shown in FIG. 24, a cabinet style slicer stand 900 can also be created that would accommodate several slicers 901 and provide the benefits of a single cooling system for multiple slicers 901, while optionally providing the additional benefits of a work surface 902 for the individuals who use the food slicers 901. The upper surface 902 of stand 900 may be chilled by one or more of the cooling systems described above.

The cabinet could house a compressor driven refrigeration system which could provide chilled liquid coolant or chilled air.

FIG. 24 also shows a cabinet stand 900 with conduit passageways 903 which provide a chilled cooling medium for the slicer base 904 and also provides a chilled work surface 902 which is connected to the source of chilled cooling medium. FIG. 24 also shows the optional use of a seal 905 between the base of the slicer 901 and the cabinet 900.

By sealing the base 904 of the slicer 901 to the top of the cabinet 900 or slicer stand the cooling system is more efficient and meat debris and food juices will not be allowed to reach the area underneath the slicer 901. Stand 900 can also be manufactured utilizing insulation.

As shown in FIG. 26, in yet another embodiment, the refrigerated deli case 1001 can be designed to include cooling medium ports 1002 to provide chilled media, such as a non-toxic, anti-bacterial antifreeze type coolant, cooled water or cooled air therethrough, for use by one or more meat slicers, scales and work surfaces that may be utilized in conjunction with the deli case 1001 itself. For example scales are commonly placed upon the upper ledge or rear ledge of deli cases 1001. Some manufacturers of refrigerated deli cases also provide shelves for a meat slicer, thus it would be an easy matter to provide easily accessible hook-ups 1002 for chilled cooling media, such as nontoxic, anti-bacterial antifreeze type coolant, cooled water or cooled air therethrough, which would be circulated through the slicer or scale or work surface.

These various embodiments may be employed to accomplish either a stabilized reduced temperature of one or more slicer frames or a gross input of cooling that may or may not be thermostatically controlled.

Since the meat slicer blade is in contact with the food product to be sliced, it is desirable that the chilled cooled media be routed through passageways in the housing that surround developed for each model of slicer to lower the blade temperature to the desired level.

The desired location of the cooling media passageways and size of same are determined by the style of the slicer and the amount of motor heat that is generated by that particular model of slicer, and by the desire to reduce the temperature in those areas of the slicer that come in contact with food.

Figure 27:
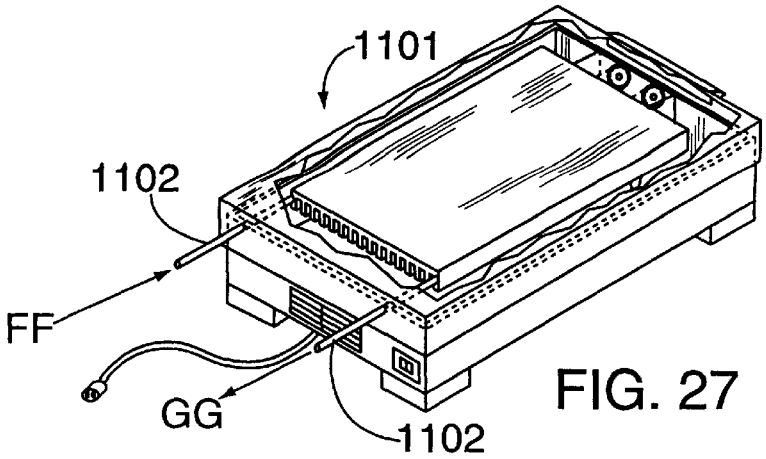
FIG. 27 is a perspective view of a seventeenth embodiment for a stand-alone food preparation surface unit, with the arrows showing the flow of a cooling medium therethrough.

FIG. 27 shows another stand-alone food preparation surface unit 1101, with the arrows "FF" and "GG" showing the flow of a cooling medium through conduits 1102. A water pump 1103 may enhance the flow of cooling medium. Alternately, pump 1103 may be located within the interior of a refrigerated display case, such as display case 1101, or in a food slicer, weighing scale or stand alone heat exchanger to chill coolant by moving chilled air such as the type found inside of a refrigerated delicatessen case across the optionally finned coils to chill the liquid coolant contained therein. Chilled liquid coolant medium (source not shown) is pumped through the stand alone food preparation work surface device, to cool the food preparation surface.

Figure 27A:
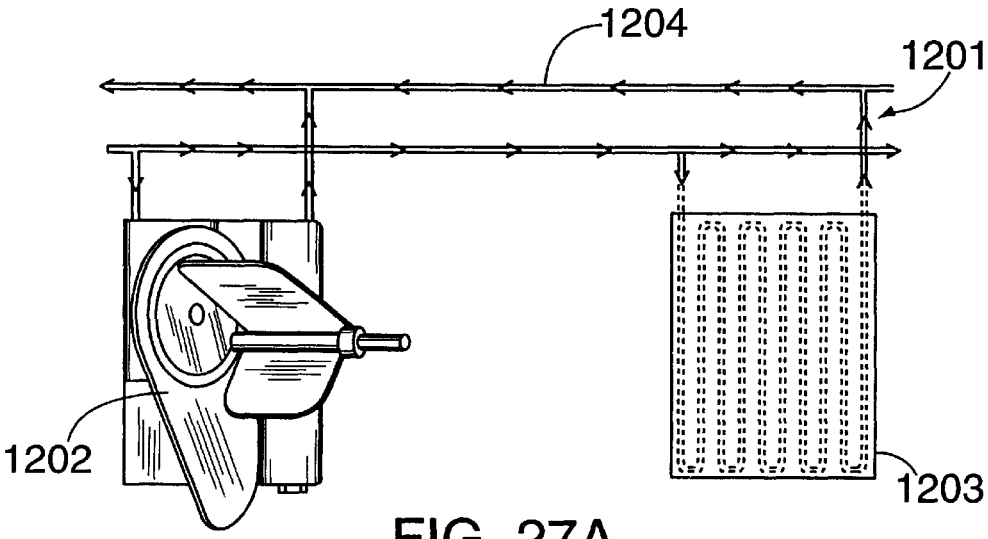
FIG. 27A is a top plan view of a fourteenth embodiment for a multi-hookup work station showing a food slicer and a chilled food preparation surface.
Figure 27B:
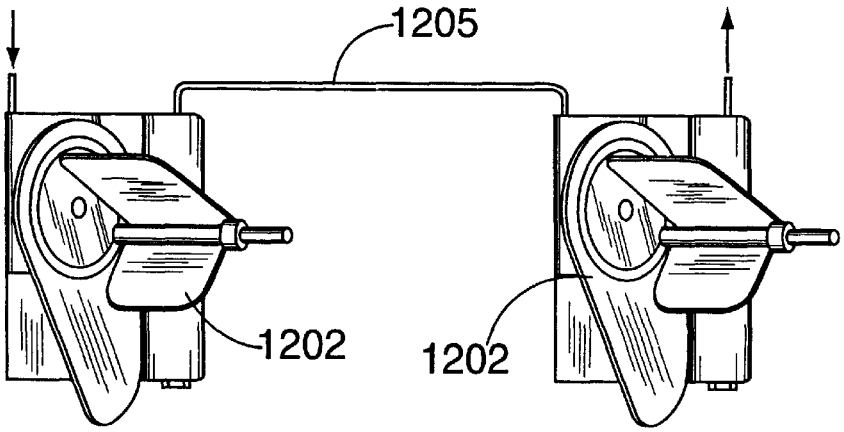
FIG. 27B is a top plan view of a fifteenth embodiment for a multi-hookup work station showing two food slicers.

As shown in FIG. 27A, a multi-hookup work station 1201 includes one or more food slicers 1202 and one or more chilled food preparation surfaces 1203, such a type 1101, connected by conduit passageways 1204 to a source of a cooling medium (not shown). FIG. 27B shows the multi-hookup work station 1201 showing two food slicers 1202 connected by conduit passageways 1205 to a source of a cooling medium (not shown). In FIGS. 27A and 27B, the arrows indicate the flow of cooling medium therethrough. In one flow pattern, FIG. 27A shows a flow in parallel of a cooling medium through conduit passageways 1204. However, FIG. 27B shows another flow pattern with a flow in series of a cooling medium through conduit passageways 1205.

Figure 28:
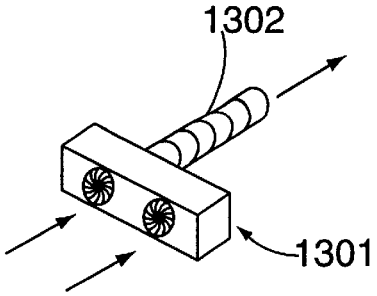
FIG. 28 is a close-up detail perspective view of a sixteenth embodiment for an air pump portion used to direct cooled air from a refrigerated food display delicatessen case.
Figure 28A:
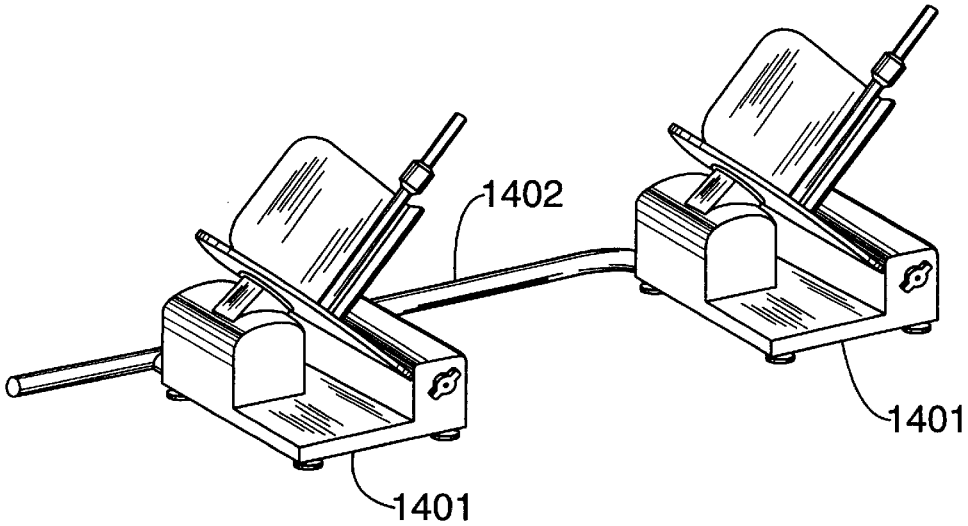
FIG. 28A is a perspective view of a seventeenth embodiment for two food slicers connected to a common conduit for passage of a cooling medium therethrough.

As shown in FIG. 28, an air pump 1301 may direct cooled air from a refrigerated food display delicatessen case, such as display case 1001, through coupling 1302 to one or more food slicers, weighing scales or food preparation surfaces. Air pump 1301 may push or pull chilled air through a chilled air trunk line 1402 to one or more food slicers 1401, as shown in FIG. 28A. The air pump can be located in the device to be cooled or in the interior of the refrigerated case or remotely at any other site.

Figure 29:
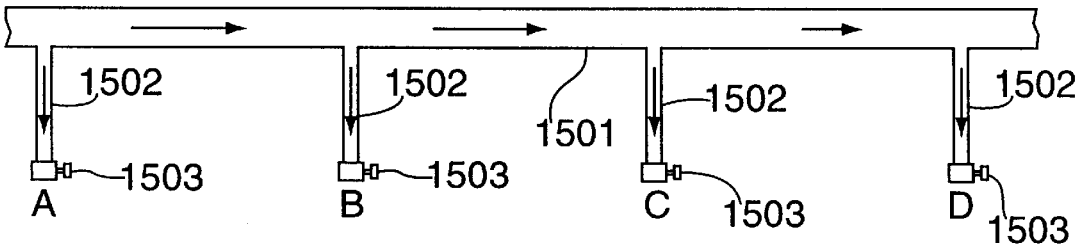
FIG. 29 is a cross sectional view of an eighteenth embodiment for a chilled air trunk line for use with multiple work stations.
Figure 29A:
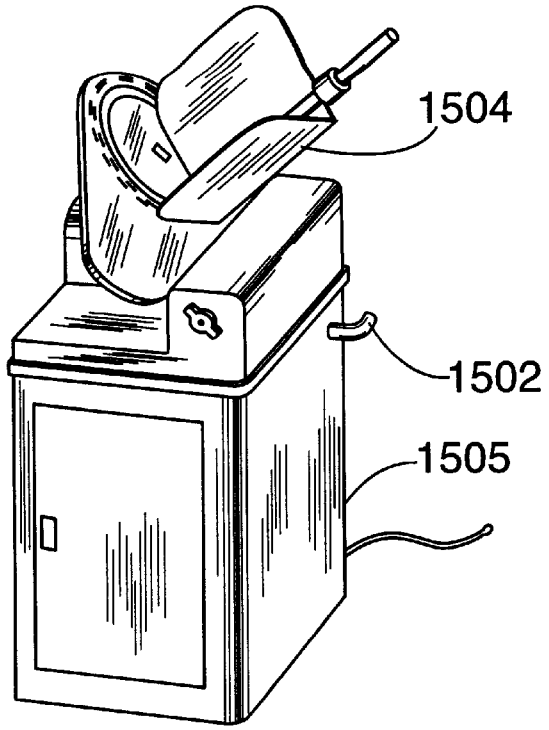
FIG. 29A is a perspective view of a food slicer cabinet shown with its own source for generating chilled air, such as by utilizing a compressor driven refrigeration system, and a hookup to the chilled air trunk line of FIG. 29.

As shown in FIG. 29, a chilled air trunk line 1501 may be coupled to conduits 1502 and valves 1503 to multiple work stations, such as slicer cabinets 1504 shown in FIG. 29A, with their own source for generating chilled air, such as by utilizing a compressor driven refrigeration system. Chilled air trunk line 1501 can provide chilled air from a free standing refrigeration system 1505, or from a refrigerated food display case, such as display case 1001 of FIG. 26.

Figure 30:
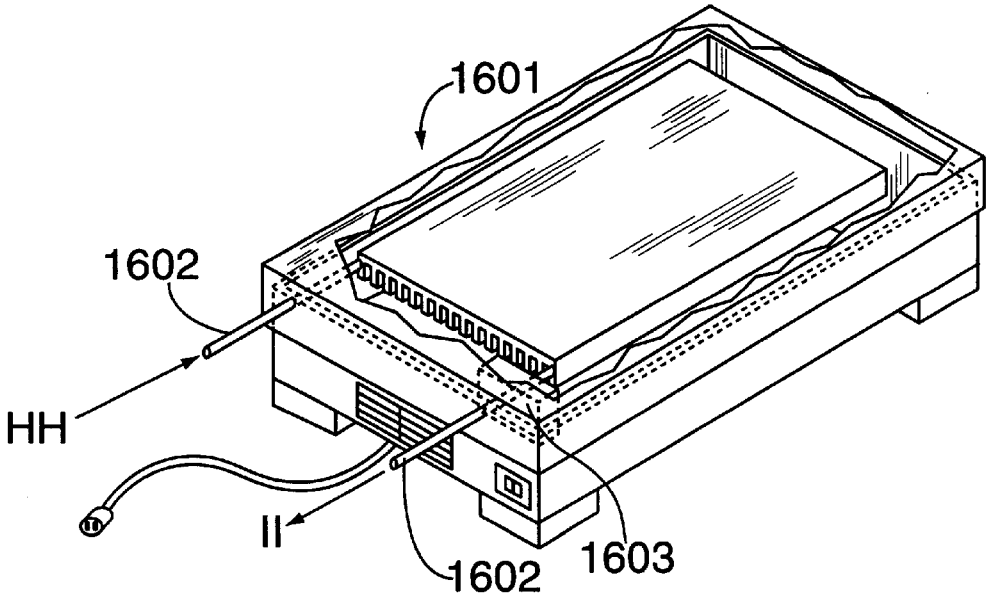
FIG. 30 is a perspective view of a nineteenth embodiment for a stand-alone food preparation surface shown with conduits for introduction and exiting of a cooling medium therethrough, wherein further an optional air or water pump is provided.

FIG. 30 shows a stand-alone food preparation surface unit 1601 shown with conduits 1602 for introduction and exiting of a cooling medium therethrough, as indicated by entrance arrows "HH" and exit arrows "II", wherein further an optional air or water pump 1603 is provided. Food 30 also represents a stand alone food preparation work surface device that can utilize larger passageways and chilled air (source not shown) to chill the work surface. In that instance the optional water pump becomes an optional air pump.

As shown in FIGS. 31 and 31A, refrigerated food display case 1001 may be modified to provide ports sufficient to allow the introduction of a male engaging portion from a modified scale, slicer or food preparation work surface device (all of which may optionally use high conductivity fins shown) to enter into the interior of the refrigerated food display case, thus allowing the transfer of cooling into the intended device. Food display case 1001 includes port 1702 for the engagement of weighing scale 1701 to refrigerated display case 1001. The chilled temperature of the refrigerated display case 1001 is transferred to weighing scale 1701, which is chilled by use of optional fins 1703, as shown in the drawing. Port 1702 can accommodate other food handling devices, such as slicers or stand accommodate other food handling devices, such as slicers or stand alone food preparation surfaces, and port 1702 may comprise additional ports 1702 on other portions of display case 1001, such as other portions of the top, or front, rear or sides thereof.

Figure 32:
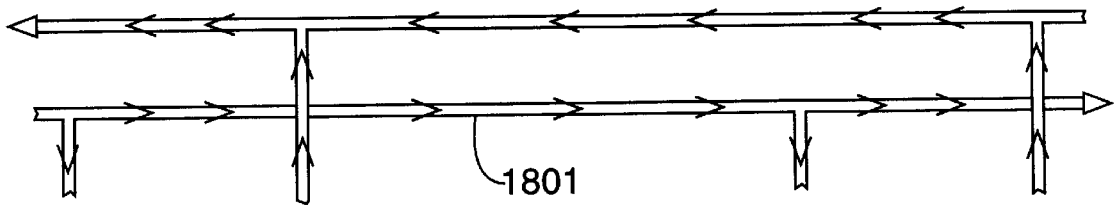
FIG. 32 is a cross sectional view of a twenty first embodiment for a chilled liquid trunk line for use with multiple work stations.
Figure 32A:
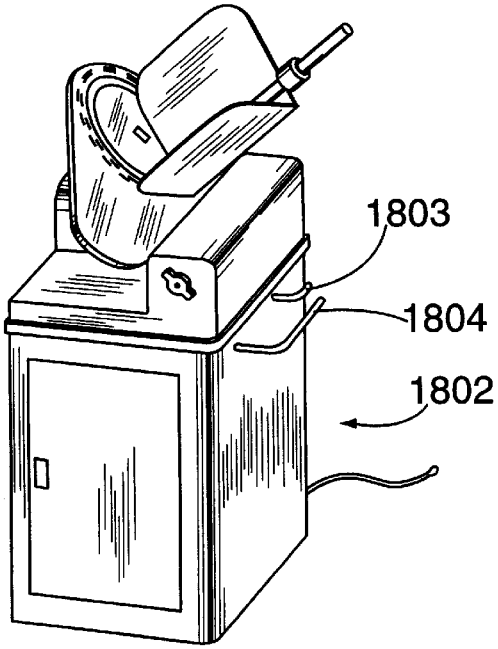
FIG. 32A is a perspective view of a food slicer-cabinet with its own source for generating chilled liquid, such as by utilizing a compressor driven refrigeration system, and also shown with a chilled liquid inlet and outlet lines an a hookup to the chilled liquid trunk line of FIG. 32.

FIG. 32 shows a chilled liquid trunk line 1801 for use with multiple work stations, such as one or more food slicer cabinets 1802, weighing scales (not shown) or food preparation surface (no shown). As shown in FIG. 32A, food slicer cabinet 1802 includes its own source for generating chilled air, such as by utilizing a compressor driven refrigeration system, as well as for generating chilled liquid to route to outlet 1804 and ultimately to inlet 1803 connectable to the chilled liquid trunk line 1801 shown in FIG. 32.

In order to reduce humidity and odors associated with the food handling devices of the present invention, a simple filter containing clinoptilolite material may be employed at the air intake or outlet portions of the food handling devices of the present invention. Clinoptilolite is a silicate material found in volcanic and sedimentary rocks. Its ability to lower humidity levels and to absorb odors has been reported since the late 1800's. As part of the present invention, one may include the use of ZEOLITE, the commercial equivalent to clinoptilolite, as a filtration material in the following embodiments of the invention. It should also be understood that ZEOLITE may be used with other similar embodiments of this invention.

The clinoptilolite-containing filter may be located at the air intake side, prior to entering the device or equipment to be cooled, of those embodiments which utilize chilled air that is blown into the interior of the frame of a slicer, or the underside of a scale platform where the food resides, or underneath a food preparation surface, such as is used to prepare sandwiches or other foods.

The clinoptilolite-containing filter may also be located at the base of a food slicer, that is being cooled by either forced chilled air, chilled liquid cooling medium which is circulated through the base and/or frame of the slicer, or chilled through the use of thermoelectric modules.

The clinoptilolite-containing filter may also be located at the base of the food preparation work surface that is being cooled by either forced chilled air, chilled liquid cooling medium which is circulated through the base and frame of the food work surface, or chilled through the use of thermoelectric modules.

Furthermore, the clinoptilolite-containing filter may also be located at the base of the scale, that is being cooled by either chilled air, chilled liquid cooling medium, which is circulated through the base and frame scale, or chilled through the use of thermoelectric modules.

Finally, the clinoptilolite-containing filter may also be located at the base or housing of any food preparation equipment or machine described in the application for patent covering this invention, that is being cooled by either forced chilled air, chilled liquid cooling medium which is circulated through the base and frame of same, or chilled through the use of thermoelectric modules.

It is further noted that other modifications may be made to the present invention, without departing from the scope of the present invention, as noted in the appended claims.

We claim:

1. A cooler apparatus to inhibit bacterial and microbial growth on a food contact surface of at least one portable food handling device being operated at ambient air temperature, such as a slicing machine, a weighing scale or a continuous, flat, seamless food preparation surface, said cooler apparatus comprising a cooler impinging upon a surface of the at least one food handling device, said cooler reducing from ambient air temperature the temperature of the food contacting surface of the at least one food handling device to a predetermined temperature for inhibiting the bacterial and microbial growth thereon, said cooler apparatus including a distributor for distributing at least one cooling medium from at least one source thereof to said surface of said at least one food handling device.

2. The cooler apparatus as in claim 1 wherein said cooler is a thermoelectric module.

3. The cooler apparatus as in claim 1 wherein said cooler of cooling medium is a refrigeration unit with an outlet for transfer of cooled liquid therethrough.

4. The cooler apparatus as in claim 1 wherein said source of cooling medium is a refrigerated food display case.

5. The cooler apparatus as in claim 1 wherein said source of cooling medium is a refrigeration unit with an outlet for transfer of cooled air therethrough.

6. The cooling apparatus to inhibit bacterial and microbial growth on a food contact surface of said at least one food handling device as in claim 1, wherein said distributor comprises a source of cooled medium and at least one conduit passageway within said at least one food handling device, said at least one conduit passageway providing said cooled medium to said conductive surface of said at least one food handling device.

7. The cooling apparatus as in claim 6 wherein said at least one food handling device comprises at least one food slicer.

8. The cooling apparatus as in claim 6 wherein said at least one food handling device comprises at least one food weighing scale.

9. The cooling apparatus as in claim 6 wherein said at least one food handling device comprises at least one food preparation surface.

10. The cooling apparatus as in claim 6 wherein said at least one food handling device comprises a plurality of food slicers.

11. The cooling apparatus as in claim 6 wherein said at least one food handling device comprises a plurality of food weighing scales.

12. The cooling apparatus as in claim 6 wherein said at least one food handling device comprises a plurality of food preparation surfaces.

13. The cooling apparatus as in claim 6 wherein said at least one food handling device comprises a combination of food handling devices.

14. The cooling apparatus as in claim 1 wherein said cooler includes a heat exchanger located inside of a stand alone box type housing which, when placed inside of a refrigerated food case allows the chilled air inside of said refrigerated food case to be drawn through said housing across said heat exchanger.

15. The cooling apparatus as in claim 14 wherein said heat exchanger optionally includes fins for efficient heat transfer and for transfer of chilled temperature of the ambient air into a liquid cooled medium contained inside of conduit passageways within said cooling apparatus.

16. The cooling apparatus as in claim 6 wherein said at least one conduit passageway comprises a plurality of conduit passageways.

17. The cooling apparatus as in claim 6 wherein said at least one food handling device comprises a plurality of food handling devices.

18. The cooling apparatus as in claim 6 wherein said cooled medium is a thermally conductive liquid.

19. The cooling apparatus as in claim 6 wherein said cooled medium is water.

20. The cooling apparatus as in claim 6 wherein said cooled medium is a non-toxic, anti-bacterial antifreeze type coolant.

21. The cooling apparatus as in claim 6 wherein said cooled medium is any other medium which can transmit temperature efficiently.

22. The cooling apparatus as in claim 6 wherein said cooled medium is cooled air.

23. The cooling apparatus as in claim 6 wherein said at least one conduit passageway is attached within a frame of said at least one food handling device.

24. The cooling apparatus as in claim 6 wherein said at least one conduit passageway is attached within a mounting stand for said at least one food handling device.

25. The cooling apparatus as in claim 6 wherein said at least one conduit passageway draws cooled air from a refrigerated cabinet to said at least one food handling device.

26. The cooling apparatus as in claim 6 wherein said at least one conduit passageway is attached within a frame of a food weighing scale.

27. The cooling apparatus as in claim 6 wherein said at least one conduit passageway is attached below a stand alone heat exchanger engagable with a food preparation surface.

28. The cooling apparatus as in claim 6 wherein said distributor comprises a cooling coil.

29. The cooling apparatus as in claim 6 wherein said distributor comprises a chilled air trunk line.

30. The cooling apparatus as in claim 6 wherein said distributor comprises a chilled liquid trunk line.

31. The cooling apparatus as in claim 6 wherein said distributor further comprises a blower/fan directing chilled air from the vicinity of said at least one conduit passageway to said at least one food handling device.

32. The cooling apparatus as in claim 6 wherein said distributor further comprises an exhaust unit exhausting heat from out of said at least one food handling device.

33. The cooling apparatus as in claim 6 wherein said distributor further comprises at least one quick disconnect coupling attaching said at least one conduit passageway to said at least one food handling device.

34. The cooling apparatus as in claim 6 wherein said at least one conduit passageway further includes at least one back flow prevention valve.

35. The cooling apparatus as in claim 6 wherein said at least one conduit passageway further includes at least one leak monitor.

36. The cooling apparatus as in claim 6 wherein said at least one cooler further includes at least one indicator of low coolant level.

37. The cooling apparatus as in claim 6 wherein said at least one cooler includes at least one indicator of excessively high temperature level.

38. The cooling apparatus as in claim 6 wherein said at least one conduit passageway comprises at least one separate tube.

39. The cooling apparatus as in claim 6 wherein said at least one conduit passageway comprises at least one molded-in tube.

40. The cooling apparatus as in claim 6 wherein said at least one conduit passageway comprises at least one cast-in tube.

41. The cooling apparatus as in claim 6 wherein said distributor further comprises at least one compressor driven refrigeration system.

42. The cooling apparatus as in claim 6 wherein said cooler apparatus is separated from said at least one food handling device by at least one seal.

43. The cooling apparatus as in claim 6 further comprising at least one humidity and odor reduction filter.

44. The cooling apparatus as in claim 6 wherein said at least one humidity and odor reduction filter comprises clinoptilolite.

45. The cooling apparatus as in claim 1 wherein said cooling medium is a liquid non-toxic, anti bacterial anti-freeze type coolant.

46. The cooling apparatus as in claim 1 wherein said cooling medium is water.

47. The cooling apparatus as in claim 1 wherein said cooling medium is air.

48. A cooler apparatus to inhibit bacterial and microbial growth on a food contact surface of at least one portable food handling device being operated at ambient air temperature, such as a slicing machine, a weighing scale or a continuous, flat, seamless food preparation surface, said cooler apparatus comprising a cooler impinging upon a surface of the at least one food handling device, said cooler reducing from ambient air temperature the temperature of the food contacting surface of the at least one food handling device to a predetermined temperature for inhibiting the bacterial and microbial growth thereon, said cooler apparatus including a distributor for distributing at least one cooling medium from at least one external source thereof to said surface of said at least one food handling device.

* * * * *